US006512329B1

(12) United States Patent
Mitsutake et al.

(10) Patent No.: US 6,512,329 B1
(45) **Date of Patent: *Jan. 28, 2003**

(54) IMAGE FORMING APPARATUS HAVING SPACERS JOINED WITH A SOFT MEMBER AND METHOD OF MANUFACTURING THE SAME

(75) Inventors: Hideaki Mitsutake; Hiroshi Takagi; Yoichi Ohsato, all of Yokohama; Noriaki Ohguri; Masahiro Fushimi, both of Zama; Kazuo Kuroda, Atsugi; Yoshimasa Okamura, Odawara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/049,973

(22) Filed: Mar. 30, 1998

(30) Foreign Application Priority Data

Mar. 31, 1997 (JP) ..... 9-081275
Mar. 19, 1998 (JP) ..... 10-070091

(51) Int. Cl.[7] ..... H01J 1/62

(52) U.S. Cl. ..... 313/495; 313/292; 313/496; 313/422; 313/258; 445/24

(58) Field of Search ..... 313/292, 495, 313/496, 422, 258, 482, 497; 445/24, 25, 51

(56) References Cited

U.S. PATENT DOCUMENTS 4,904,895 A 2/1990 Tsukamoto et al. ..... 313/336
5,066,883 A 11/1991 Yoshioka et al. ..... 313/309
5,561,343 A * 10/1996 Lowe ..... 313/496
5,667,418 A 9/1997 Fahlen et al. ..... 445/25
5,746,635 A * 5/1998 Spindt et al. ..... 445/24
5,760,538 A 6/1998 Misutake et al. ..... 313/422
5,811,927 A 9/1998 Anderson et al. ..... 313/495
5,936,343 A * 8/1999 Fushimi et al.
6,278,233 B1 * 8/2001 Sanou et al.

FOREIGN PATENT DOCUMENTS

EP 0 394 698 10/1990
EP 0 634 775 1/1995

(List continued on next page.)

OTHER PUBLICATIONS

C.A. Mead, "Operation of Tunnel–Emission Devices," Journal of Applied Physics, vol. 32, No. 4, pp. 646–652 (Apr. 1961).
C.A. Spindt, et al., "Physical Properties of Thin–Film Field Emission Cathodes with Molybdenum Cones," Journal of Applied Physics, vol. 47, No. 12, pp. 5248–5263 (Dec. 1976).
W.P. Dyke, et al., "Field Emission," Advances in Electronics and Electron Physics, vol. VIII, pp. 89–185 (1956).
M.I. Elinson, et al., "The Emission of Hot Electrons and the Field Emission of Electrons From Tin Oxide," Radio Engineering and Electronic Physics, pp. 1290–1296 (Jul. 1965).
G. Dittmer, "Electrical Conduction and Electron Emission of Discontinuous Thin Films," Thin Solid Films, vol. 9, pp. 317–328 (1972).

(List continued on next page.)

*Primary Examiner*—Vip Patel
*Assistant Examiner*—Joseph Williams
(74) *Attorney, Agent, or Firm*—Fitzpatrick, Cella, Harper & Scinto

(57) ABSTRACT

The image forming apparatus comprises an electron source having a substrate on which a plurality of electron emitting devices are arranged, a face plate provided with fluorescent substances for emitting light of different colors and serving to form a color image upon irradiation of electrons by the electron emitting devices. Rectangular spacers are arrange between the substrate and the face plate and are fixed to the face plate and contacted to the substrate via soft members.

22 Claims, 19 Drawing Sheets

U.S. PATENT DOCUMENTS

| | | |
|---|---|---|
| EP | 0 712 149 | 5/1996 |
| EP | 0 725 420 | 8/1996 |
| EP | 0 747 925 | 12/1996 |
| EP | 0 757 371 | 2/1997 |
| EP | 0 814 491 | 12/1997 |
| JP | 63-274047 | 11/1988 |
| JP | 64-31332 | 2/1989 |
| JP | 2-257551 | 10/1990 |
| JP | 3-55738 | 3/1991 |
| JP | 4-28137 | 1/1992 |
| JP | 7-140481 | 6/1995 |
| JP | 7-230776 | 8/1995 |
| JP | 7-282743 | 10/1995 |
| JP | 7-326306 | 12/1995 |
| JP | 8-7794 | 1/1996 |
| JP | 9-7532 | 1/1997 |
| JP | 10-83778 | 3/1998 |
| WO | WO 94/15244 | 7/1994 |

OTHER PUBLICATIONS

M. Hartwell, et al., "Strong Electron Emission From Patterned Tin–Indium Oxide Thin Films," International Electron Devices Meeting, pp. 519–521 (1975).

H. Araki, et al., "Electroforming and Electron Emission of Carbon Thin Films," Journal of the Vaccum Society of Japan, vol. 26, No. 1, pp. 22–29 (1983).

R. Meyer, et al., "Recent Development on "Microtips" Display at LETI", Technical Digest of IVMC 91, pp. 6–9 (1991).

* cited by examiner

R : RED FLUORESCENT SUBSTANCE
G : GREEN FLUORESCENT SUBSTANCE
B : BLUE FLUORESCENT SUBSTANCE

R : RED FLUORESCENT SUBSTANCE
G : GREEN FLUORESCENT SUBSTANCE
B : BLUE FLUORESCENT SUBSTANCE

IMAGE FORMING APPARATUS HAVING SPACERS JOINED WITH A SOFT MEMBER AND METHOD OF MANUFACTURING THE SAME

BACKGROUND OF THE INVENTION

1. Field of the Invention

The present invention relates to an image forming apparatus having a multi-electron source and fluorescent substances, and method of manufacturing the image forming apparatus.

2. Description of the Related Art

Flat display apparatuses are thin and lightweight. Attention is therefore being given to them as apparatuses replacing CRT type display apparatuses. A display apparatus using a combination of an electron-emitting device and a fluorescent substance which emits light upon reception of an electron beam, in particular, is expected to have better characteristics than display apparatuses based on other conventional schemes. For example, in comparison with recent popular liquid crystal display apparatuses, the above display apparatus is superior in that it does not require a backlight because it is of a self-emission type and that it has a wide view angle.

Conventionally, two types of devices, namely hot and cold cathode devices, are known as electron-emitting devices. Known examples of the cold cathode devices are surface-conduction emission (SCE) type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example-of the surface-conduction emission type emitting devices is described in, e.g., M. I. Elinson, "Radio Eng. Electron Phys., 10, 1290 (1965) and other examples will be described later.

The surface-conduction emission type emitting device utilizes the phenomenon that electrons are emitted from a small-area thin film formed on a substrate by flowing a current parallel through the film surface. The surface-conduction emission type emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 15 is a plan view showing the device by M. Hartwell et al. described above as a typical example of the device structures of these surface-conduction emission type emitting devices. Referring to FIG. 15, reference numeral 3001 denotes a substrate; and 3004, a conductive thin film made of a metal oxide formed by sputtering. This conductive thin film 3004 has an H-shaped pattern, as shown in FIG. 15. An electron-emitting portion 3005 is formed by performing electrification processing (referred to as forming processing to be described later) with respect to the conductive thin film 3004. An interval L in FIG. 15 is set go to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction emission type emitting devices by M. Hartwell et al. and the like, typically the electron-emitting portion 3005 is formed by performing electrification processing called forming processing for the conductive thin film 3004 before electron emission. In the forming processing, for example, a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenum cones", J. Appl. Phys., 47, 5248 (1976).

FIG. 16 is a sectional view showing the device by C. A. Spindt et al. described above as a typical example of the FE type device structure. Referring to FIG. 16, reference numeral 3010 denotes a substrate; 3011, emitter wiring made of a conductive material; 3012, an emitter cone; 3013, an insulating layer; and 3014, agate electrode. In this device, a voltage is applied between the emitter cone 3012 and the gate electrode 3014 to emit electrons from the distal end portion of the emitter cone 3012. As another FE type device structure, there is an example in which an emitter and a gate electrode are arranged on a substrate to be almost parallel to the surface of the substrate, in addition to the multi-layered structure of FIG. 16.

A known example of the MIM type electron-emitting devices is described in C. A. Mead, "Operation of Tunnel-Emission Devices", J. Appl. Phys., 32,646 (1961). FIG. 17 shows a typical example of the MIM type device structure. FIG. 17 is a sectional view of the MIM type electron-emitting device. Referring to FIG. 17, reference numeral 3020 denotes a substrate; 3021, a lower electrode made of a metal; 3022, a thin insulating layer having a thickness of about 100 angstrom; and 3023, an upper electrode made of a metal and having a thickness of about 80 to 300 angstrom. In the MIM type electron-emitting device, an appropriate voltage is applied between the upper electrode 3023 and the lower electrode 3021 to emit electrons from the surface of the upper electrode 3023.

Since the above-described cold cathode devices can emit electrons at a temperature lower than that for hot cathode devices, they do not require any heater. The cold cathode device therefore has a structure simpler than that of the hot cathode device and can be micropatterned. Even if a large number of devices are arranged on a substrate at a high density, problems such as heat fusion of the substrate hardly arise. In addition, the response speed of the cold cathode device is high, while the response speed of the hot cathode device is low because it operates upon heating by a heater. For this reason, applications of the cold cathode devices have enthusiastically been studied.

Of cold cathode devices, the above surface-conduction emission type emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface-conduction emission type emitting devices to, e.g., image forming apparatuses such as an image display apparatus and an image recording apparatus, a multi-electron source, and the like have been studied.

As an application to image display apparatuses, in particular, as disclosed in the U.S. Pat. No. 5,066,883 and Japanese Patent Laid-Open Nos. 2-257551 and 4-28137 filed by the present applicant, image display apparatus using the combination of a surface-conduction emission type emitting device and a fluorescent substance which emits light upon reception of an electron beam has been studied. This type of image display apparatus using the combination of the surface-conduction emission type emitting device and the fluorescent substance is expected to have more excellent characteristics than other conventional image display apparatuses. For example, in comparison with recent popular liquid crystal display apparatuses, the above display apparatus is superior in that it does not require a backlight because it is of a self-emission type and that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat display apparatus reported by R. Meyer et al. [R. Meyer: "Recent Development on Microtips Display at LETI", Tech. Digest of 4th Int. Vacuum Microelectronics Conf., Nagahama, pp. 6–9 (1991)].

An example of an application of a larger number of MIM type electron-emitting devices arranged side by side to an image display apparatus is disclosed in Japanese Patent Laid-Open No. 3-55738 filed by the present applicant.

FIG. 18 is a partially cutaway perspective view of an example of a display panel portion as a constituent of a flat image display apparatus, showing the internal structure of the panel.

Referring to FIG. 18, reference numeral 3115 denotes a rear plate; 3116, a side wall; and 3117, a face plate. The rear plate 3115, the side wall 3116, and the face plate 3117 constitute an envelope (airtight container) for maintaining a vacuum in the display panel.

The rear plate 3115 has a substrate 3111 fixed thereon, on which N×M cold cathode devices 3112 are formed (M and N are positive integers equal to 2 or more, and properly set in accordance with a desired number of display pixels). The N×M cold cathode devices 3112 are arranged in a matrix with M row-direction wirings 3113 and N column-direction wirings 3114. The portion constituted by the substrate 3111, the cold cathode devices 3112, the row-direction wirings 3113, and the column-direction wirings 3114 will be referred to as a multi electron source. An insulating layer (not shown) is formed between each row-direction wiring 3113 and each column-direction wiring 3114, at least at a portion where they cross each other at a right angle, to maintain electric insulation therebetween.

A fluorescent film 3118 made of fluorescent substances is formed on the lower surface of the face plate 3117. The fluorescent film 3118 is coated with red (R), green (G), and blue (B) fluorescent substances (not shown), i.e., three primary color fluorescent substances. Black conductive members (not shown) are provided between the respective color fluorescent substances of the fluorescent film 3118. A metal back 3119 made of aluminum (Al) or the like is formed on the surface of the fluorescent film 3118, located on the rear plate 3115 side. Reference symbols Dx1 to DxM, Dy1 to DyN, and Hv denote electric connection terminals for an airtight structure provided to electrically connect the display panel to an electric circuit (not shown). The terminals Dx1 to DxM are electrically connected to the row-direction wirings 3113 of the multi electron source; the terminals Dy1 to DyN, to the column-direction wirings 3114; and the terminal Hv, to the metal back 3119 of the face plate.

A vacuum of about $10^{-6}$ Torr is held in the above airtight container. As the display area of the image display apparatus increases, the apparatus requires a means for preventing the rear plate 3115 and the face plate 3117 from being deformed or destroyed by the pressure difference between the inside and outside of the airtight container. A method of thickening the rear plate 3115 and the face plate 3117 will increase the weight of the image display apparatus and cause an image distortion or parallax when the display screen is obliquely seen. In contrast to this, the structure shown in FIG. 18 includes structure support members (called spacers or ribs) 3120 formed of a relatively thin glass plate and used to resist the atmospheric pressure. With this structure, a spacing of sub-millimeters or several millimeters is generally ensured between the substrate 3111 on which the multi electron source is formed and the face plate 3117 on which the fluorescent film 3118 is formed, and a high vacuum is maintained in the airtight container, as described above.

In the image display apparatus using the above display panel, when voltages are applied to the respective cold cathode devices 3112 through the outer terminals Dx1 to DxM and Dy1 to DyN, electrons are emitted by the cold cathode devices 3112. At the same time, a high voltage of several hundred to several kV is applied to the metal back 3119 through the outer terminal Hv to accelerate the emitted electrons to cause them to collide with the inner surface of the face plate 3117. With this operation, the respective color fluorescent substances constituting the fluorescent film 3118 are excited to emit light. As a result, an image is displayed on the screen.

The following problem is posed in the display panel of the image display apparatus described above.

The spacers 3120 arranged in the image display apparatus must be sufficiently positioned and assembled with respect to the substrate 3111 and the face plate 3117. Particularly, the spacers 3120 must be sufficiently positioned with respect to the fluorescent film 3118 on the face plate 3117 side so as not to break display pixels by the spacers; otherwise, the quality of a displayed image may degrade.

If the spacers 3120 are not fixedly arranged in the image display apparatus, the spacers may greatly shift, fall down, and be damaged owing to an external shock to the panel upon or after assembling the airtight container.

SUMMARY OF THE INVENTION

The present invention has been made in consideration of the above conventional techniques, and has as its principal object to provide an image forming apparatus having spacers being fixedly fastened inside the apparatus.

It is another object of the present invention to provide an image forming apparatus having spacers which are fixed on an image forming member but only abutted on a member opposing the image forming member, and are fixedly fastened inside the apparatus.

It is still another object of the present invention to provide a method of manufacturing an image forming apparatus, which can facilitate arrangement of spacers in assembling the image forming apparatus.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

An image forming apparatus according to the present invention comprises spacers placed between an image forming member and a member opposing the image forming member. The spacers are fixed to the image forming member, and are in contact with the member opposing the image forming member.

In a method of manufacturing an image forming apparatus according to the present invention, the spacers placed between an image forming member and a member opposing the image forming member are first fixed to the image forming member and brought into contact with the member opposing the image forming member.

In the present invention, it is preferable that the spacer is brought into contact with the member opposing the image forming member via a soft member. The soft member is softer than a basic material of the spacer and a material of the member opposing the image forming member with which the space is brought into contact.

The basic material of the spacer may be a glass material or a ceramic material as described later. The Vickers hardness of a softer one of the glass materials is about 500. The material of the member opposing the image forming member may be printed wirings (silver paste having Ag and glass components is printed and burned) on a substrate (as described later) of the multi-elector source. The Vickers hardness of the printed wirings is almost the same or less than that of the glass material. Therefore, the Vickers hardness of the soft material is about 200 or less than 100 so that the effects of the present invention are effectively attained. For example, precious metals such as Au, Pt, Pd, Rh and Ag, or a parts of alloy of metals, such as Cu, have Vickers hardness of less than 50, those materials are preferable for the material of the soft material.

Figure 18:
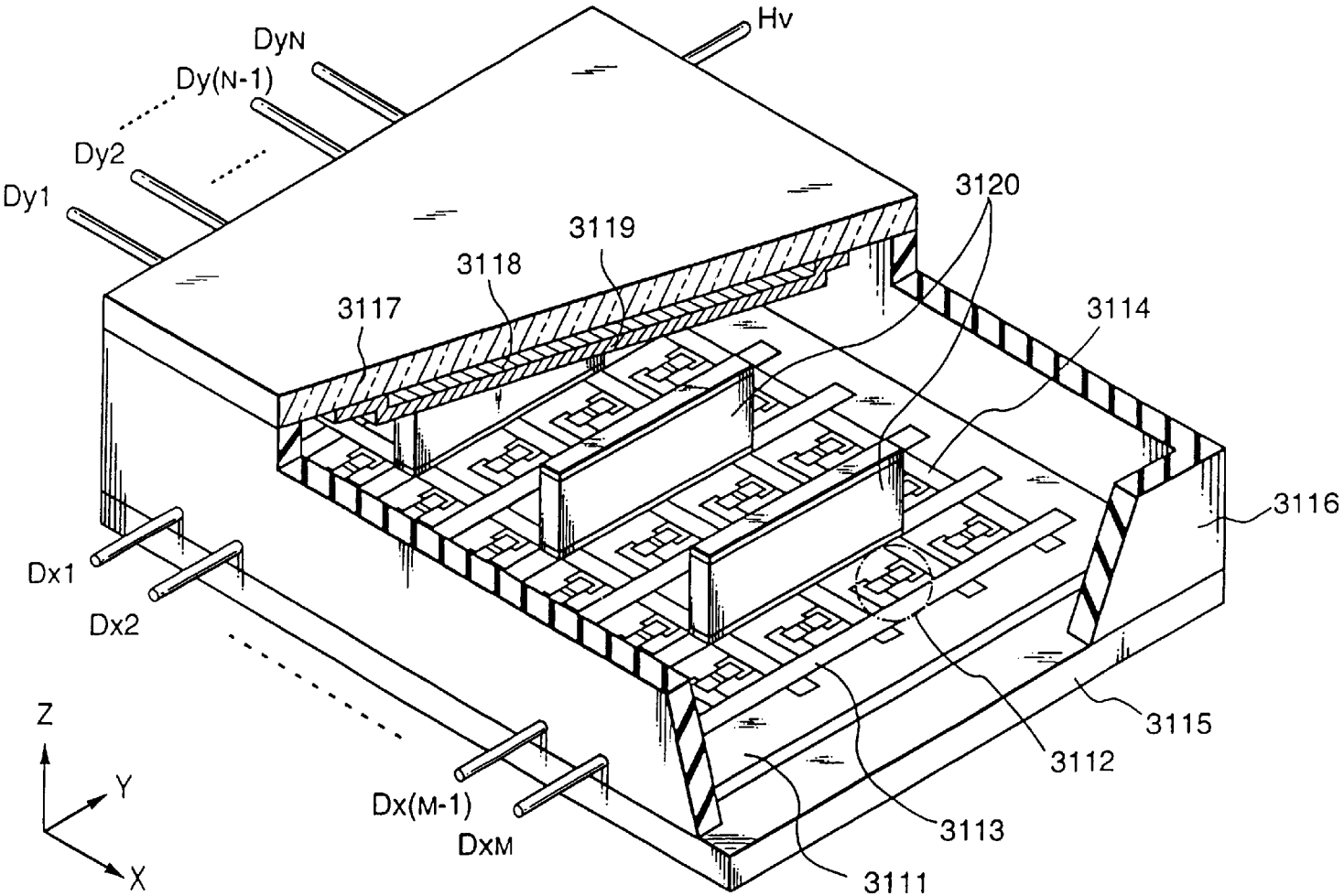
FIG. 18 (PRIOR ART)
FIG. 18 is a partially cutaway perspective view showing the display panel of an image display apparatus.

The spacer in the present invention includes both an insulating spacer and a conductive spacer. For example, in the image forming apparatus shown in FIG. 18, the following points must be taken into consideration.

First, when some of the electrons emitted from a portion near the spacer 3120 collide with the spacer 3120, or ions produced owing the effect of emitted electrons are attached to the spacer 3120, the spacer 3120 may be charged. Further, if some of the electrons which have reached the face plate 3117 are reflected and scattered by the face plate 3117, and some of the scattered electrons collide with the spacer 3120, the spacer 3120 maybe charged. If the spacer 3120 is charged in this manner, the orbits of the electrons emitted by the cold cathode devices 3112 are deflected. As a result, the electrons reach improper positions on fluorescent substances, and a distorted image is displayed near the spacer 3120.

Second, since a high voltage of several hundred V or more (i.e., a high electric field of 1 kV/mm or more) is applied between the face plate 3117 and the multi electron source for accelerating the electrons emitted by the cold cathode devices 3112, discharge may occur on the surface of the spacer 3120. When the spacer 3120 is charged as in the above case, in particular, discharge may be induced.

In consideration of the above points, a spacer having insulating properties good enough to stand a high application voltage and also having a conductive surface that can relieve the above charged state is preferably used in the present invention to suppress deflection of the orbits of electron beams and discharge near the spacer.

According to the present invention, when the conductive spacer is arranged, the spacer is preferably electrically connected to a conductive member arranged on an image forming member and a conductive member arranged on a member opposing the image forming member. In this arrangement, the charge of the spacer can be removed by flowing a small current through the spacer.

For example, when the member opposing the image forming member is a substrate on which a plurality of electron emitting devices are arranged, and the spacer is fixed with a conductive adhesive to the substrate on which the electron emitting devices are arranged, the adhesive must be prevented from being squeezed out. This is because the squeezed adhesive on the substrate on which the electron emitting devices are arranged may disturb the electric field near the spacer and influence the orbits of electrons emitted by the electron-emitting devices near the spacer. In the present invention, however, since the spacer is simply brought into contact with the member opposing the image forming member, and is not fixed to the member opposing the image forming member with the adhesive or the like, the above influence on the orbits of emitted electrons need not be considered.

In the present invention, when the conductive spacer is arranged, the soft member is made of a noble metal material (to be described later). Contact of the spacer with the member opposing the image forming member via such a soft metal can improve the electrical connection.

An electron source in the present invention includes an electron source having cold cathode devices or hot cathode devices. An electron source having cold cathode devices such as surface-conduction emission type emitting devices, FE type devices, MIM type devices, or the like is preferably used in the present invention. An electron source having surface-conduction emission type emitting devices, in particular, is more preferably used in the present invention.

Since the above-described cold cathode devices can emit electrons at a temperature lower than that for hot cathode devices, they do not require any heater. The cold cathode device therefore has a structure simpler than that of the hot cathode device and can be micropatterned. Even if a large number of devices are arranged on a substrate at a high density, problems such as heat fusion of the substrate hardly arise. In addition, the response speed of the cold cathode device is high, while the response speed of the hot cathode device is low because it operates upon heating by a heater.

For example, of all the cold cathode devices, a surface-conduction emission type emitting device, in particular, has a simple structure and can be easily manufactured, and a large number of such devices can be formed throughout a large area.

According to the present invention, each spacer is preferably fixed to the image forming member by bonding the spacer to the image forming member. For example, the spacer may be bonded to the image forming member with a joining material such as frit glass which is fused when heated.

The image forming apparatus of the present invention has the following forms.

(1) An electrode is arranged on the image forming member. This electrode is an accelerating electrode for accelerating electrons emitted by the electron source. In the image forming apparatus, an image is formed by irradiating the electrons emitted by the electron source on the image forming member in accordance with an input signal. In the image display apparatus, the image forming member is particularly a fluorescent substance.

(2) The electron source is an electron source having a simple matrix layout in which a plurality of electron-emitting devices are wired in a matrix by a plurality of row-direction wirings and a plurality of column-direction wirings.

(3) The electron source maybe an electron source having a ladder-shaped layout in which a plurality of rows (to be referred to as a row direction hereinafter) of a plurality of electron-emitting devices arranged parallel and connected at two terminals of each device are arranged, and a control electrode (to be referred to as a grid hereinafter) arranged above the electron-emitting devices along the direction (to be referred to as a column direction hereinafter) perpendicular to these ladder wirings controls electrons emitted by the electron-emitting devices.

(4) According to the concepts of the present invention, the image forming apparatus is not limited to an image forming apparatus suitable for display. The above-mentioned image forming apparatus can also be used as a light-emitting source instead of a light-emitting diode for an optical printer made up of a photosensitive drum, the light-emitting diode, and the like. At this time, by properly selecting M row-direction wirings and N column-direction wirings, the image forming apparatus can be applied as not only a linear light-emitting source but also a two-dimensional light-emitting source. In this case, the image forming member is not limited to a substance which directly emits light, such as a fluorescent substance used in embodiments (to be described below), but may be a member on which a latent image is formed by charging of electrons.

A preferred embodiment of the present invention will be described in detail below with reference to the accompanying drawings.

The structure of the spacer and a method of assembling the apparatus, as the features of the embodiment of the present invention, will be explained.

Figure 1:
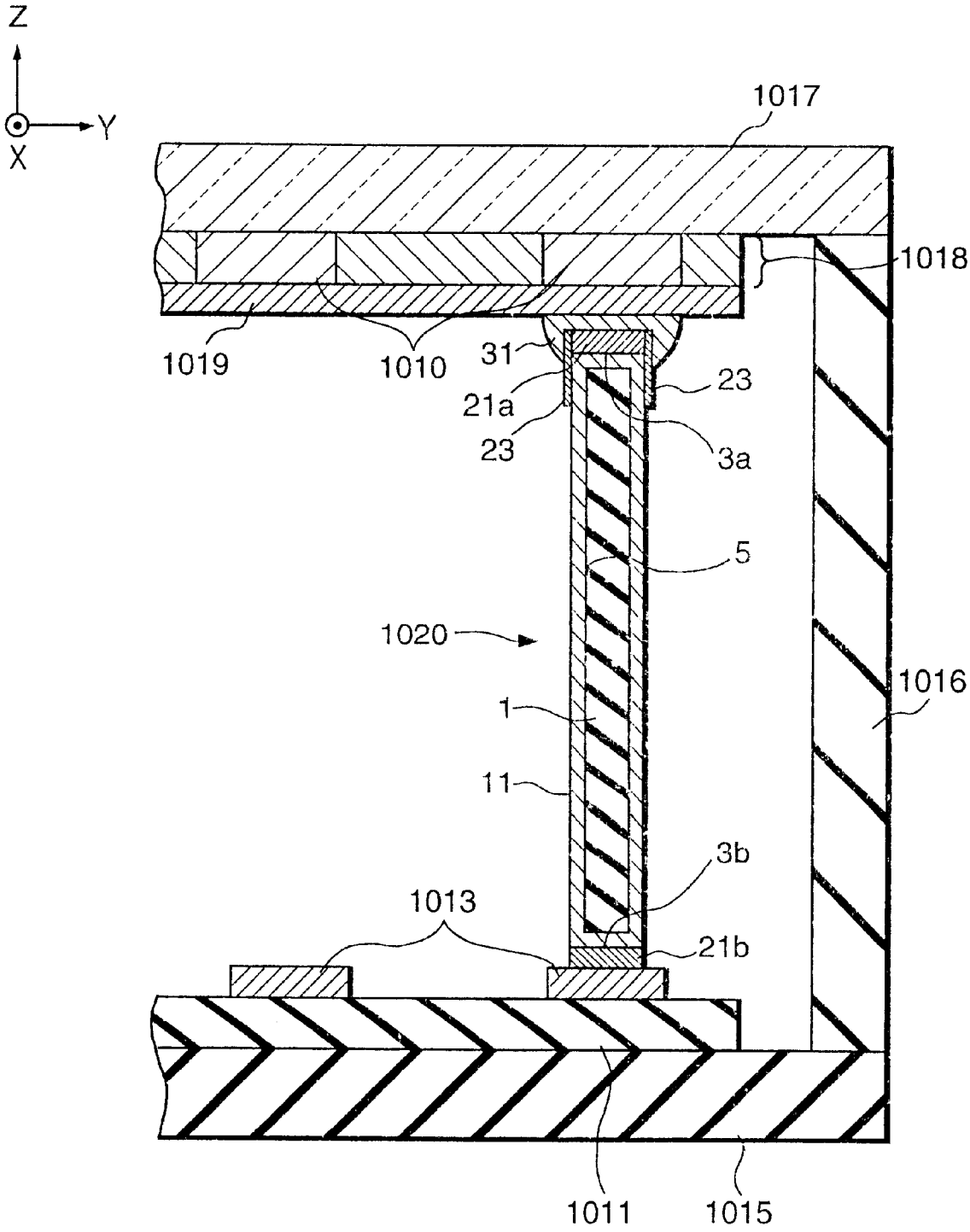
FIG. 1 is a sectional view taken along a line A—A' of a display panel (FIG. 2) according to an embodiment of the present invention.
Figure 2:
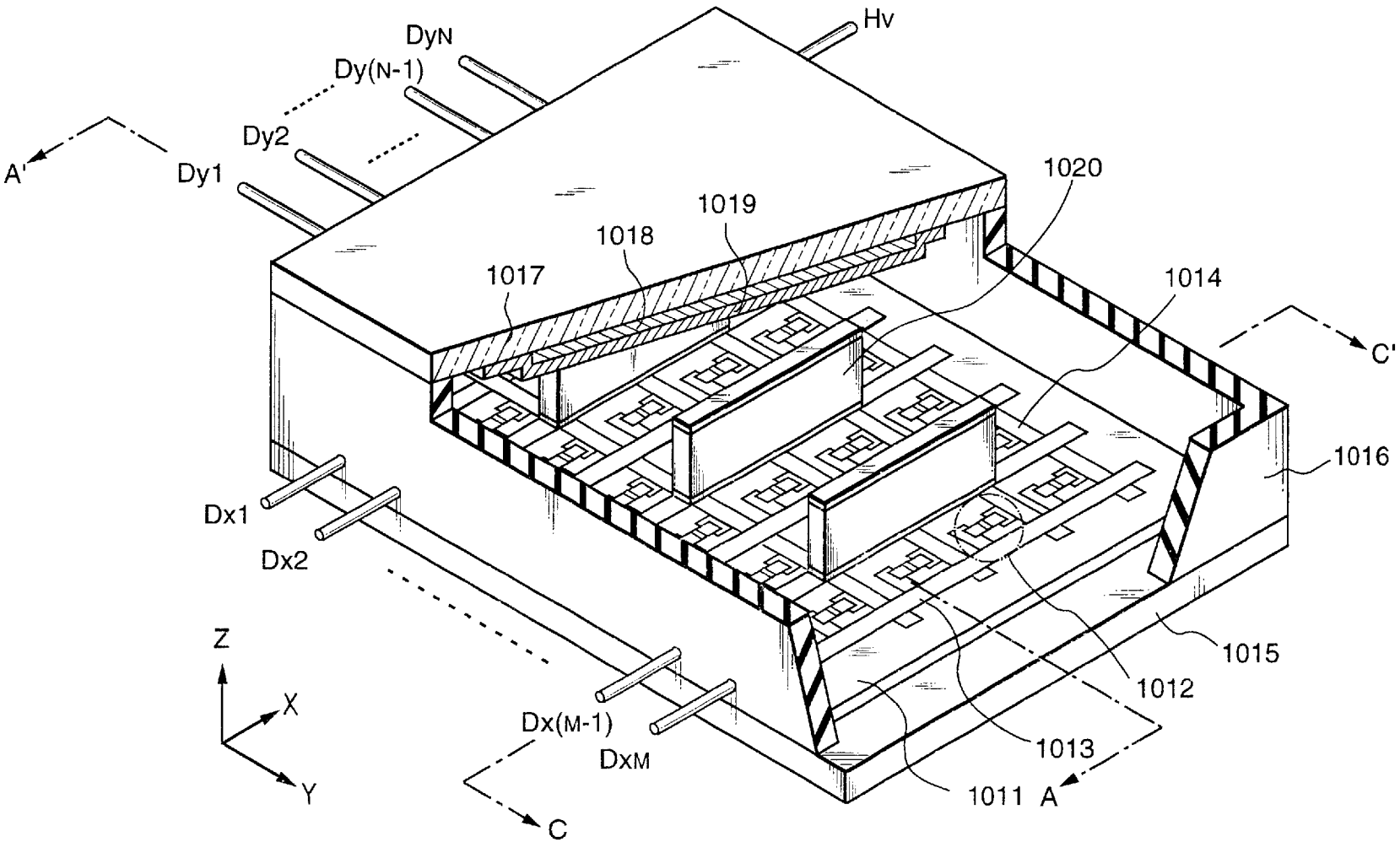
FIG. 2 is a partially cutaway perspective view showing the display panel of an image display apparatus according to the embodiment.

FIG. 1 is a partial sectional view of a display panel showing the characteristic portion of an image display apparatus according to the embodiment. FIG. 2 schematically shows the structure of the display panel (to be described in detail later). FIG. 1 shows a cross-section, taken along a line A-A', of the display panel having a structure in which a substrate 1011 having a plurality of cold cathode devices 1012 and a transparent face plate 1017 having a fluorescent film 1018 serving as a light-emitting material film face each other through a spacer 1020.

The spacer 1020 is constituted by forming a high-resistance film 11 on the surface of an insulating member 1 to prevent charge-up, and forming low-resistance films 21*a* and 21*b* on abutment surfaces 3*a* and 3*b* of the spacer which respectively face the inner surface of the face plate 1017 and the surface of the substrate 1011. The spacer 1020 is fixed to only the inner surface of the face plate 1017 via a conductive joining material 31. Then, the face plate 1017 and the substrate 1011 are assembled as a display panel. Accordingly, the high-resistance film 11 of the spacer 1020 is electrically connected to the metal back 1019 formed on the inner surface of the face plate 1017 via the low-resistance film 21*a* and the joining material 31, and to a row-direction wiring 1013 formed on the substrate 1011 via the low-resistance film 21*b*.

A protective film 23 is formed on the side surface of the spacer contacting the abutment surface 3*a* of the spacer 1020 on the face plate 1017 side so as to prevent the joining material 31 from directly contacting the high-resistance film 11. The protective film 23 is preferably made of a material having low reactivity with respect to the joining material 31. The low-resistance film 21*a* desirably also functions as a protective film by making the film 21*a* of a material having low reactivity with respect to the joining material 31, and extending the film 21*a* to the side surface of the spacer.

In this display panel, the low-resistance film 21*b* of the spacer 1020 on the substrate 1011 side where the cold cathode devices 1012 for emitting electrons are formed is formed on only the abutment surface 3*b* on the substrate 1011 side. The potential distribution near the substrate 1011 remains unchanged, compared to the case wherein no spacer 1020 is arranged. Therefore, the orbits of electrons emitted by the cold cathode devices 1012 near the spacer 1020 do not change.

The mechanical or chemical influence on the high-resistance film 11 in fixing the spacer 1020 to the face plate 1017 side via the joining material 31 can be avoided by the protective film 23 which is formed on the side surface contacting the abutment surface 3*a* against the face plate 1017 side with which accelerated electrons collide. Particularly at the joining portion between the high-resistance film 11 and the low-resistance film 21*a* where the three, high-resistance film 11, low-resistance film 21*a*, and joining material 31 (further, the four films including the insulating member 1) contact each other, chemical reaction easily occurs during heating and the like in manufacturing the display panel. It is therefore significant to avoid the influence on the joining portion by the protective film 23. When the protective film 23 is formed of the extended low-resistance film 21*a*, the potential distribution near the face plate 1017 may be distorted. The electrons emitted by the cold cathode devices 1012 are however accelerated to a great degree near the face plate 1017, so the influence of the distortion of the potential distribution on the orbits of the electrons are negligible.

The arrangement of the display panel of the image display apparatus and a method of manufacturing the same according to this embodiment will be described in detail.

FIG. 2 is a partially cutaway perspective view of a display panel used in this embodiment, showing the internal structure of the display panel.

In FIG. 2, reference numeral 1015 denotes a rear plate; numeral 1016 denotes a side wall; and numeral 1017 denotes a face plate. These parts constitute an airtight container for maintaining the inside of the display panel vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for exhausting air from the inside of the container will be described later. In addition, since a vacuum of about $10^{-6}$ Torr is maintained in the above airtight container, the spacers 1020 are arranged as a structure resistant to the atmospheric pressure to prevent the airtight container from being destroyed by the atmospheric pressure or an unexpected impact.

The rear plate 1015 has the substrate 1011 fixed thereon, on which N×M cold cathode devices 1012 are formed (M, N=positive integer equal to 2 or more, properly set in accordance with a desired number of display pixels. For example, in a display apparatus for high-resolution television display, preferably N=3,000 or more, M=1,000 or more). The N×M cold cathode devices are arranged in a simple matrix with the M row-direction wirings 1013 and the N column-direction wirings 1014. The portion constituted by the components denoted by references 1011 to 1014 will be referred to as a multi electron source.

If the multi electron source used in the image display apparatus according to this embodiment is an electron source constituted by cold cathode devices arranged in a simple matrix, the material and shape of each cold cathode device and the manufacturing method are not specifically limited. For example, therefore, cold cathode devices such as surface-conduction emission type emitting devices, FE type devices, or MIM devices can be used.

Next, the structure of a multi electron source having surface-conduction emission type emitting devices (to be described later) arranged as cold cathode devices on a substrate with the simple-matrix wiring will be described below.

Figure 3:
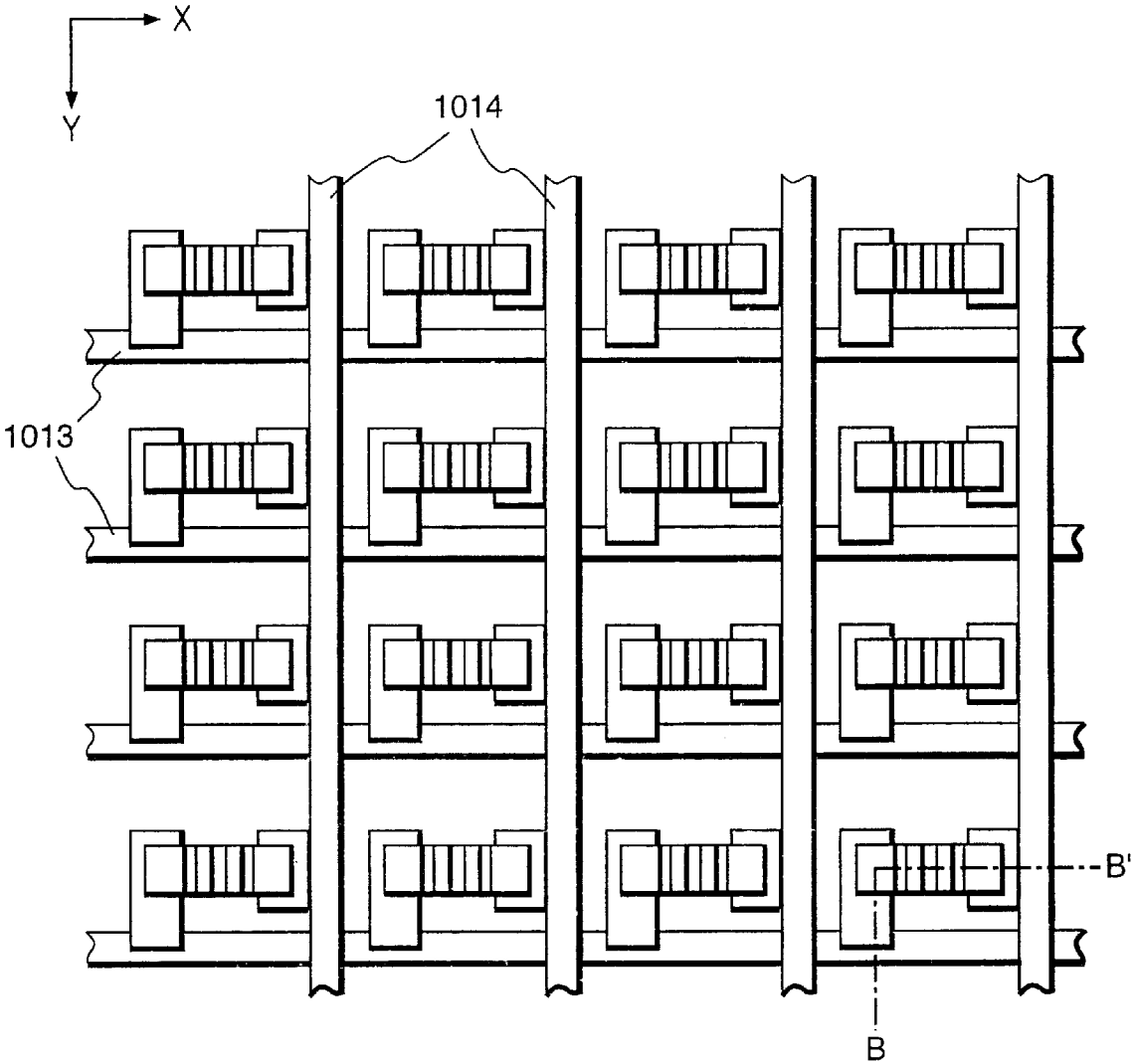
FIG. 3 is a plan view showing part of the substrate of a multi electron source used in the embodiment.

FIG. 3 is a plan view of the multi electron source used in the display panel in FIG. 2. There are surface-conduction emission type emitting devices like the one shown in FIGS. 7A and 7B on the substrate 1011. These devices are arranged in a simple matrix with the row-direction wiring 1013 and the column-direction wiring 1014. At an intersection of the wirings 1013 and 1014, an insulating layer (not shown) is formed between the wires, to maintain electrical insulation.

Figure 4:
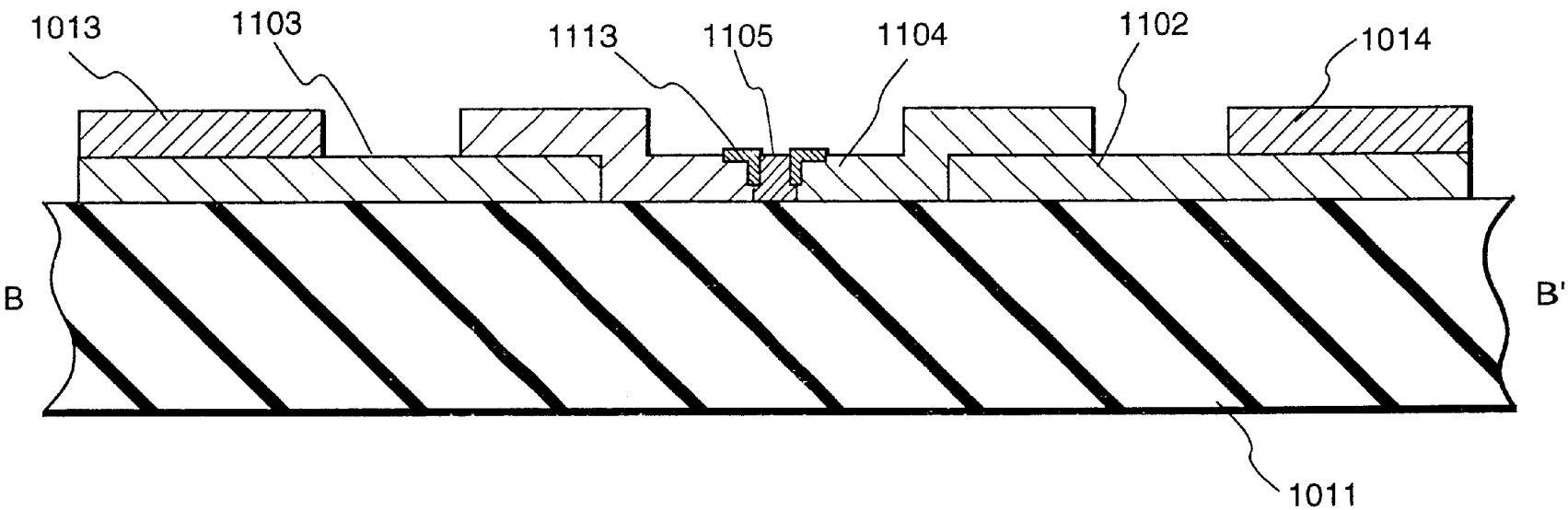
FIG. 4 is a sectional view showing part of the substrate of the multi electron source used in the embodiment.

FIG. 4 shows a cross-section cut out along the line B-B' in FIG. 3.

Note that a multi electron source having such a structure is manufactured by forming the row- and column-direction wirings 1013 and 1014, the inter-electrode insulating layers (not shown), and the device electrodes and conductive thin films on the substrate, then supplying electricity to the respective devices via the row- and column-direction wirings 1013 and 1014, thus performing the forming processing (to be described later) and the activation processing (to be described later).

In this embodiment, the substrate 1011 of the multi electron source is fixed to the rear plate 1015 of the airtight container. If, however, the substrate 1011 of the multi electron source has sufficient strength, the substrate 1011 of the multi electron source may also serve as the rear plate of the airtight container.

Figure 5A:
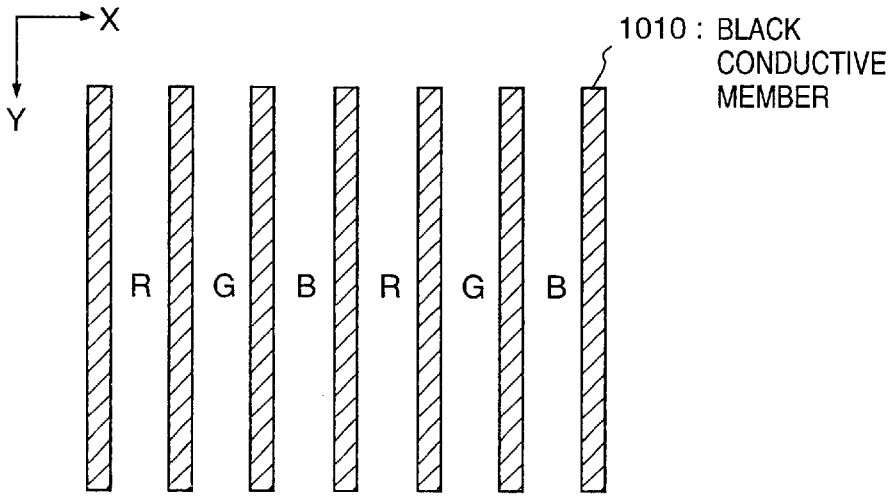
FIGS. 5A and 5B are plan views showing examples of the alignment of fluorescent substances on the face plate of the display panel according to the embodiment.

The fluorescent film 1018 is formed on the lower surface of the face plate 1017. As this embodiment is a color display apparatus, the fluorescent film 1018 is coated with red, green, and blue fluorescent substances, i.e., three primary color fluorescent substances. As shown in FIG. 5A, the respective color fluorescent substances are formed into a striped structure, and black conductive members 1010 are provided between the stripes of the fluorescent substances. The purpose of providing the black conductive members 1010 is to prevent display color misregistration even if the electron-beam irradiation position is shifted to some extent, to prevent degradation of display contrast by shutting off reflection of external light, to prevent the charge-up of the fluorescent film by the electron beam, and the like. As a material for the black conductive members 1010, graphite is used as a main component, but other materials may be used so long as the above purpose is attained.

Figure 5B:
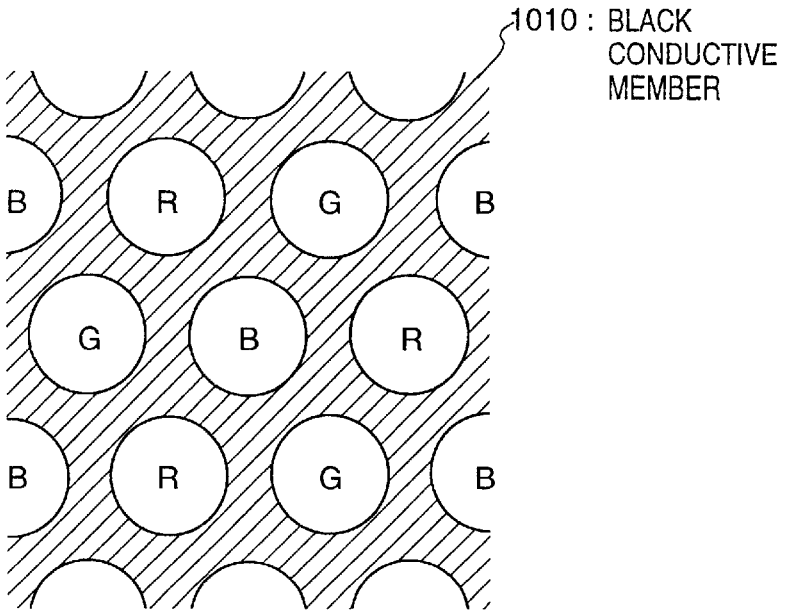
Figure 6:
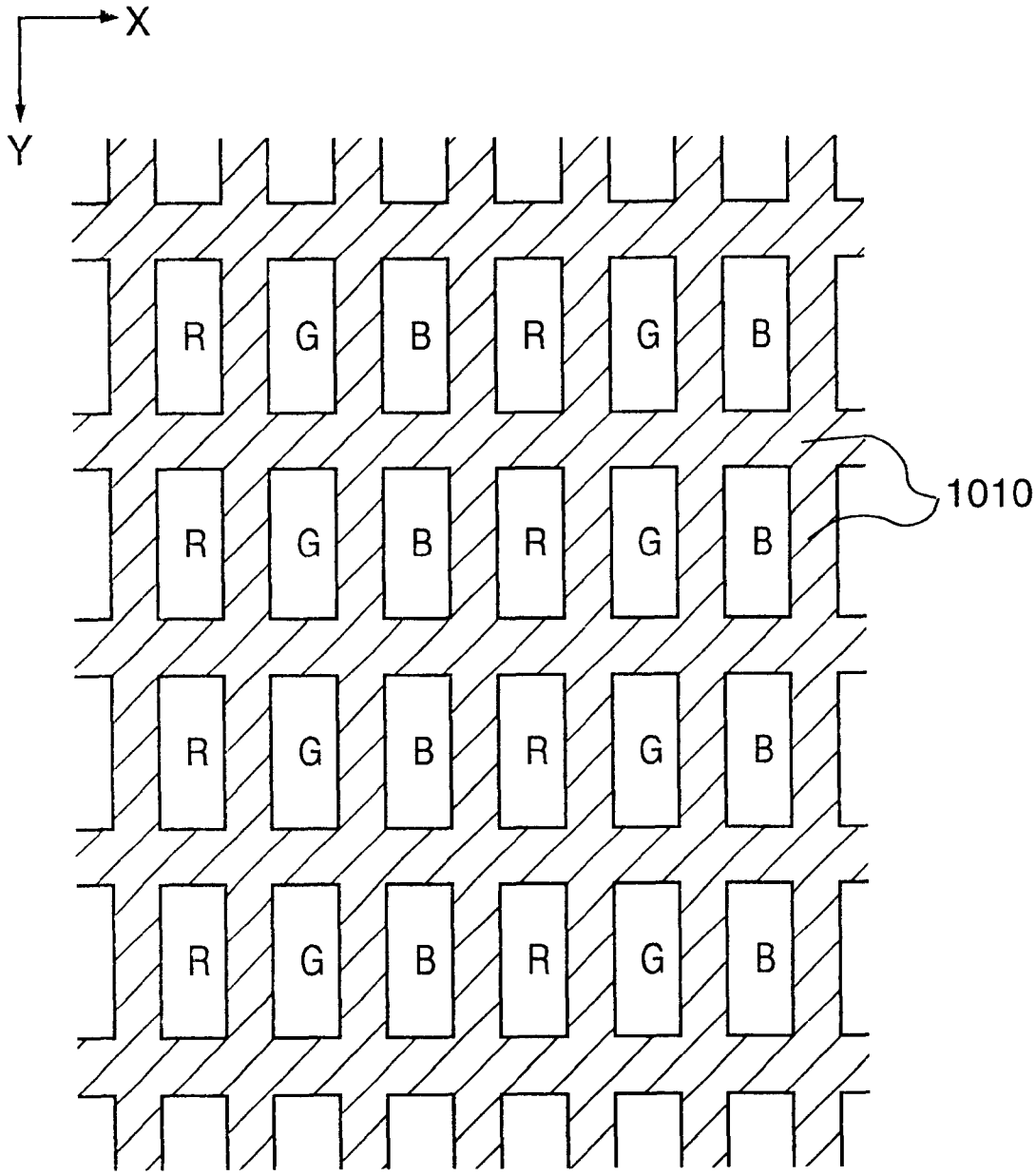
FIG. 6 is a plan view showing another example of the alignment of the fluorescent substances on the face plate of the display panel according to the embodiment.

Further, three-primary colors of the fluorescent film is not limited to the stripes as shown in FIG. 5A. For example, delta arrangement as shown in FIG. 5B or any other arrangement may be employed. For example, as shown in FIG. 6, the black conductive members 1010 may be formed not only between the stripes of the respective colors of the fluorescent film but also in the direction perpendicular to the stripes so as to separate the pixels in the row and column directions. Note that when a monochrome display panel is formed, a single-color fluorescent substance may be applied to the fluorescent film 1018, and the black conductive member may be omitted.

Furthermore, the metal back 1019, which is well-known in the CRT field, is provided on the fluorescent film 1018 on the rear plate 1015 side. The purpose of providing the metal back 1019 is to improve the light-utilization ratio by mirror-reflecting part of the light emitted by the fluorescent film 1018, to protect the fluorescent film 1018 from collision with negative ions, to be used as an electrode for applying an electron-beam accelerating voltage, to be used as a conductive path for electrons which excited the fluorescent film 1018, and the like. The metal back 1019 is formed by forming the fluorescent film 1018 on the face plate 1017, smoothing the front surface of the fluorescent film, and depositing Al (aluminum) thereon by vacuum deposition. Note that when fluorescent substances for a low voltage is used for the fluorescent film 1018, the metal back 1019 is not used.

Furthermore, for application of an accelerating voltage or improvement of the conductivity of the fluorescent film 1018, transparent electrodes made of, e.g., ITO may be provided between the face plate 1017 and the fluorescent film 1018, although such electrodes are not used in this embodiment.

In sealing the above-described container, the rear plate 1015, the face plate 1017, and the spacer 1020 must be sufficiently positioned to make the fluorescent substances in the respective colors arranged on the face plate 1017 and the devices arranged on the substrate 1011 correspond to each other.

FIG. 1 is a schematic sectional view of the display panel taken along a line A-A' in FIG. 2. The same reference numerals in FIG. 1 denote the same parts as in FIG. 2.

Each spacer 1020 is a member obtained by forming the high-resistance films 11 on the surfaces of the insulating member 1 to prevent charge-up, forming the low-resistance films 21*a* and 21*b* on the abutment surfaces 3*a* and 3*b*, of the spacer 1020, which face the inner surface (on the metal back 1019 and the like) of the face plate 1017 and the surface of the substrate 1011 (row- or column-direction wiring 1013 or 1014), and forming the protective film 23 on the side surface of the spacer 1020 on the abutment surface 3*a* side. A necessary number of spacers 1020 are fixed on the inner surface of the face plate 1017 at necessary intervals with the joining material 31 to attain the above purpose. In addition, the high-resistance films 11 are formed at least on the surfaces of the insulating member 1, which are exposed in a vacuum in the airtight container. The high-resistance films 11 are electrically connected to the inner surface of the face plate 1017 (metal back 1019 and the like) through the low-resistance film 21*a* and the joining material 31 on the spacer 1020, and to the surface of the substrate 1011 (row- or column-direction wiring 1013 or 1014) through the low-resistance film 21*b* on the spacer 1020. In this embodiment, the spacers 1020 have a thin flat shape, extend along corresponding row-direction wirings 1013 at an equal interval, and are electrically connected thereto.

The spacer 1020 preferably has insulating properties good enough to stand a high voltage applied between the row-and column-direction wirings 1013 and 1014 on the substrate 1011 and the metal back 1019 on the inner surface of the face plate 1017, and conductivity enough to prevent the surface of the spacer 1020 from being charged.

As the insulating member 1 of the spacer 1020, for example, a silica glass member, a glass member containing a small amount of an impurity such as Na, a soda-lime glass member, or a ceramic member consisting of alumina or the like is available. Note that the insulating member 1 preferably has a thermal expansion coefficient near the thermal expansion coefficients of the airtight container and the substrate 1011.

The current obtained by dividing an accelerating voltage Va applied to the face plate 1017 (the metal back 1019 and the like) on the high potential side by a resistance Rs of the high-resistance films 11 flows in the high-resistance films 11 constituting the spacer 1020. The resistance Rs of the spacer 1020 is set in a desired range from the viewpoint of prevention of charge-up and consumption power. A sheet resistance R(Ω/sq) is preferably set to $10^{12}$ Ω/sq or less from the viewpoint of prevention of charge-up. To obtain a sufficient charge-up prevention effect, the sheet resistance R is preferably set to $10^{11}$ Ω/sq or less. The lower limit of this sheet resistance depends on the shape of each spacer 1020 and the voltage applied between the spacers 1020, and is preferably set to $10^5$ Ω/sq or more.

A thickness t of the high-resistance film 11 formed on the insulating member 1 preferably falls within a range of 10 nm to 1 μm. A thin film having a thickness of 10 nm or less is generally formed into an island-like shape and exhibits unstable resistance depending on the surface energy of the material, the adhesion properties with the substrate, and the substrate temperature, resulting in poor reproduction characteristics. In contrast to this, if the thickness t is 1 μm or more, the film stress increases to increase the possibility of peeling of the film. In addition, a longer period of time is required to form a film, resulting in poor productivity. The thickness of the high-resistance film 11 preferably falls within a range of 50 to 500 nm. The sheet resistance R (Ω/sq) is ρ/t, and a resistivity ρ of the high-resistance film 11 preferably falls within a range of 0.1 Ωcm to $10^8$ Ωcm in consideration of the preferable ranges of R (Ω/sq) and t. To set the sheet resistance and the film thickness in more preferable ranges, the resistivity ρ is preferably set to $10^2$ to $10^6$ Ωcm.

As described above, when a current flows in the high-resistance films 11 formed on the insulating member 1 or the overall display generates heat during operation, the temperature of each spacer 1020 rises. If the resistance temperature coefficient of the high-resistance film 11 is a large negative value, the resistance decreases with an increase in temperature. As a result, the current flowing in the spacer 1020 increases to raise the temperature. The current keeps increasing beyond the limit of the power source. It is empirically known that the resistance temperature coefficient which causes such an excessive increase in current is a negative value whose absolute value is 1% or more. That is, in the case of a negative value, the resistance temperature coefficient of the absolute value of the high-resistance film is preferably set to less than −1%.

As a material for the high-resistance film 11 having charge-up prevention properties in the spacer 1020, for example, a metal oxide can be used. Of metal oxides, a chromium oxide, nickel oxide, or copper oxide is preferably used. This is because, these oxides have relatively low secondary electron-emitting efficiency, and are not easily charged even if the electrons emitted by the cold cathode device 1012 collide with the spacer 1020. In addition to such metal oxides, a carbon material is preferably used because it has low secondary electron-emitting efficiency. Since an amorphous carbon material has a high resistance, the resistance of the spacer 1020 can be easily controlled to a desired value.

An aluminum-transition metal alloy nitride is preferable as another material for the high-resistance film 11 having charge-up prevention characteristics because the resistance can be controlled in a wide resistance range from the resistance of a good conductor to the resistance of an insulator by adjusting the composition of the transition metal. This nitride is a stable material which undergoes only a slight change in resistance in the manufacturing process for the display apparatus (to be described later). In addition, this material has a resistance temperature coefficient of less than −1% and hence can be easily used in practice. As a transition metal element, Ti, Cr, Ta, or the like is available.

The alloy nitride film is formed on the insulating member 1 by a thin film formation means such as sputtering, reactive sputtering in a nitrogen atmosphere, electron beam deposition, ion plating, or ion-assisted deposition. A metal oxide film can also be formed by the same thin film formation method except that oxygen is used instead of nitrogen. Such a metal oxide film can also be formed by CVD or alkoxide coating. A carbon film is formed by deposition, sputtering, CVD, or plasma CVD. When an amorphous carbon film is to be formed, in particular, hydrogen is contained in an atmosphere in the process of film formation, or a hydrocarbon gas is used as a film formation gas.

The low-resistance films 21*a* and 21*b* of the spacer 1020 are formed to electrically connect the high-resistance films 11 to the face plate 1017 (metal back 1019 and the like) on the high potential side and the substrate 1011 (row- and column-direction wirings 1013 and 1014 and the like) on the low potential side. The low-resistance films 21 and 22 will also be referred to as intermediate electrode layers (intermediate layers) hereinafter. These intermediate electrode layers (intermediate layers) have a plurality of functions as described below.

(1) The low-resistance films serve to electrically connect the high-resistance films 11 to the face plate 1017 and the substrate 1011. As described above, the high-resistance films 11 are formed to prevent the surface of the spacer 1020 from being charged. When, however, the high-resistance films 11 are connected to the face plate 1017 (metal back 1019 and the like) and the substrate 1011 (wiring 1013 and 1014 and the like) directly or through the joining material 31, a large contact resistance is produced at the interface between the connecting portions. As a result, the charges produced on the surface of the spacer 1020 may not be quickly removed. To prevent this, the low-resistance intermediate layers 21*a* and 21*b* are formed on the abutment surfaces of the spacer 1020 or the side surface portions contacting the abutment surfaces, which contact the face plate 1017, the substrate 1011, and the joining material 31.

(2) The low-resistance films serve to make the potential distributions of the high-resistance films 11 uniform.

The electrons emitted by the cold cathode devices 1012 follow the orbits formed in accordance with the potential distributions formed between the face plate 1017 and the substrate 1011. To prevent the electron orbits from being disturbed near the spacers 1020, the entire potential distributions of the spacers 1020 must be controlled. When the high-resistance films 11 are connected to the face plate 1017 (metal back 1019 and the like) and the substrate 1011 (wirings 1013 and 1014 and the like) directly or through the joining material 31, variations in the connected state occurs owing to the contact resistance of the interface between the connecting portions. As a result, the potential distribution of each high-resistance film 11 may deviate from a desired value. To prevent this, the low-resistance intermediate layers (21*a* and 21*b*) are formed along the entire length of the spacer end portions (the abutment surfaces or the side surface portions contacting the abutment surfaces), of the spacer 1020, which are in contact with the face plate 1017 and the substrate 1011. By applying a desired potential to each intermediate layer portion, the overall potential of each high-resistance film 11 can be controlled.

As a material for the low-resistance films 21*a* and 21*b*, a material having a resistance sufficiently lower than that of the high-resistance film 11 can be selected. For example, such a material is properly selected from metals such as Ni, Cr, Au, Mo, W, Pt, Ti, Al, Cu, and Pd, alloys thereof, printed conductors constituted by metals such as Pd, Ag, Au, $RuO_2$, and Pd—Ag or metal oxides and glass or the like, transparent conductors such as $In_2O_3$—$SnO_2$, and semiconductor materials such as polysilicon.

One of the preferable conditions for the material of the low-resistance films 21*a* and 21*b* is to have characteristics not to increase the resistance upon changes in quality such as oxidization or coagulation and not to cause any incomplete conduction at the joining portion with the high-resistance film 11 during heating and sealing with frit glass in manufacturing the image display apparatus of this embodiment. From this viewpoint, as a preferable material for the low-resistance films 21*a* and 21*b*, a noble metal material, e.g., particularly platinum is available. In this case, the low-resistance film 21*a* made of a noble metal is desirably formed via a layer made of a metal material such as Ti, Cr, or Ta and having a thickness of several nm to several ten nm so as to have satisfactory adhesion properties with respect to the insulating member 1 or the high-resistance film 11. This layer is called an underlying layer.

The thicknesses of the low-resistance films 21*a* and 21*b* desirably fall within a range of 10 nm to 1 $\mu$m. A thin film having a thickness of 10 nm or less is generally formed into an island-like shape and exhibits unstable resistance, resulting in poor reproducibility. In contrast to this, if the thickness is 1 $\mu$m or more, the film stress increases to increase the possibility of peeling of the film. In addition, a longer period of time is required to form a film, resulting in poor productivity. The thicknesses of the low-resistance films 21*a* and 21*b* preferably fall within a range of 50 to 500 nm.

As described above, the low-resistance film 21*a* formed to electrically connect the high-resistance film 11 to the face plate 1017 (metal back 1019 and the like) on the high-potential side is preferably made of a material having low reactivity with respect to the joining material 31. Also in this case, the low-resistance film 21*a* is preferably obtained by forming a noble metal film such as a platinum film on the uppermost surface of the spacer.

A preferable material for the protective film 23 is a material which has low reactivity with respect to the joining material 31 and does not allow the component of the joining material 31 to permeate therein. For example, as a material for the protective film 23, a noble metal such as platinum can be used similar to the low-resistance film 21*a*. In this case, the low-resistance film 21*a* and the protective film 23 can be simultaneously formed of the same member. As a material for the protective film 23, very stable oxides such as $Al_2O_3$, $SiO_2$, and $Ta_2O_5$ or nitrides such as $Si_3N_4$ may be used. Note that when such an oxide or nitride is used for the protective film 23, the resistance of the protective film 23 is very high, so that the exposure area of the protective film 23 is set as small as possible from the viewpoint of prevention of charge-up and discharge so long as the joining material 31 and the high-resistance film 11 do not contact each other.

As for the abutment portion of the spacer 1020 against the substrate 1011 (wiring 1013 or 1014 and the like), since the spacer 1020 abuts against the row- or column-direction wiring 1013 or 1014 at the atmospheric pressure, the following points are preferably taken into consideration. Particularly when the row- and column-direction wirings 1013 and 1014 formed with a thickness of more than 1 mm by printing or other method of crossing each other via insulating layers (not shown), and corrugations are formed at abutment portions between the row- and column-direction wirings 1013 and 1014, the following points become very effective because the stress tends to locally concentrate.

To prevent damage of the spacer 1020, the row- and column-direction wirings 1013 and 1014, and the like owing to the concentration of the stress, a material for the low-resistance film 21*b* is preferably a softer material than materials constituting the spacer and wiring (row- or column-direction wiring) contacting the spacer.

Figure 19:
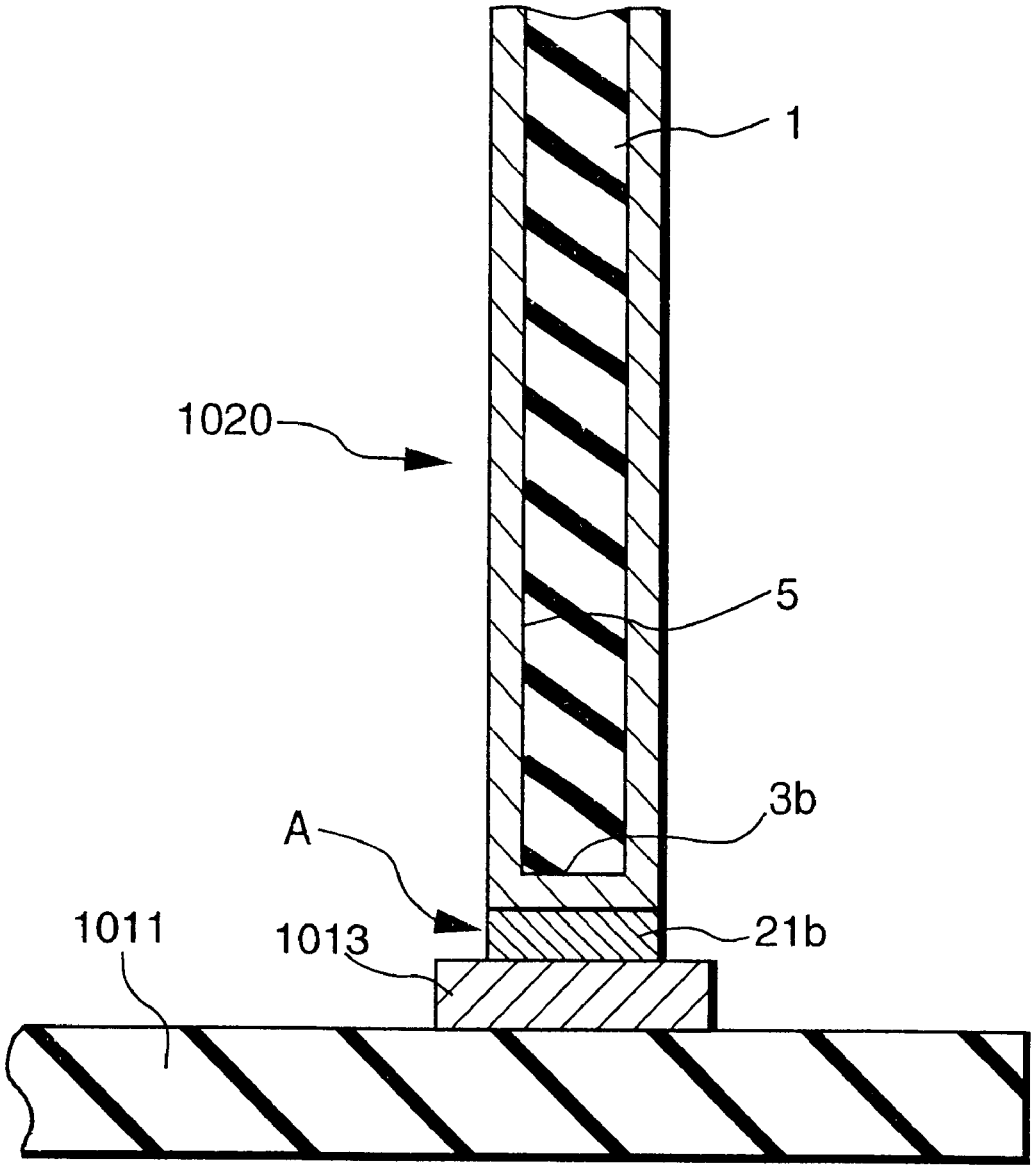
FIGS. 19 and 20 are views for explaining the stress concentration point and relief of the stress.
Figure 20:
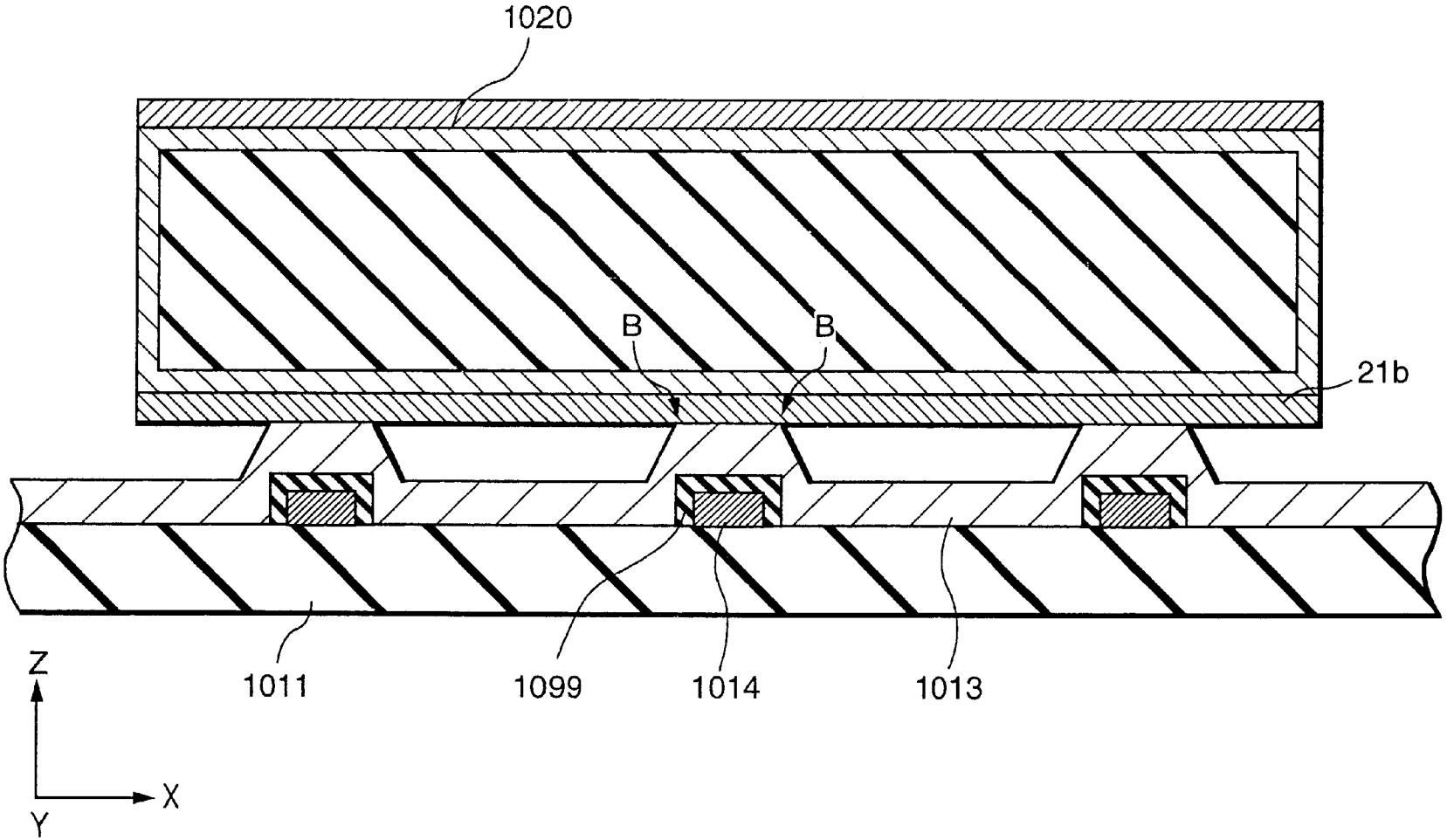

FIGS. 19 and 20 are views for explaining the effect of relieving the concentration of the stress in bringing the spacer 1020 assembled and fixed to the face plate 1017 into contact with the substrate 1011 side (wiring 1013 or 1014 or the like). FIG. 19 shows a cross section, taken along a line A-A' in FIG. 2, the same as FIG. 1, and FIG. 20 shows a cross section, taken along a line C-C' in FIG. 2.

In FIG. 19, one of the portions where the stress easily concentrates is an edge portion A at the boundary between the abutment surface 3*b* and the side surface portion 5 of the spacer 1020 on the substrate 1011 side. By covering the edge portion A with the low-resistance film 21*b* made of a soft material, the stress can be relieved to prevent damage to the spacer 1020.

In FIG. 20, the row-direction wiring 1013 has a projecting shape at the portion where the column-direction wiring 1014 and an insulating layer 1099 exist. Of the abutment points against the spacer 1020, the end portion (portion B) of the projection is also a portion where the stress easily concentrates. By covering the end portion (portion B) of the projection with the low-resistance film 21*b* made of a soft material, the stress can be relieved to prevent damage to the spacer 1020.

In the embodiment shown in FIGS. 1 and 2, the low-resistance film 21*b* is made of a softer material than a material constituting the insulating member 1 serving as the substrate of the spacer 1020, and a material constituting the wiring 1013. Such a soft material used for the low-resistance film 21*b* is preferably a platinum-based noble metal such as Pt, Pd, Rh, a noble metal such as Au or Ag, or an alloy of noble metals. As a stretchy system, the gold system, the platinum system, and an alloy system of silver and copper are particularly available. Other metals or alloys can be used as the soft material, but above-described materials are more preferable.

The joining material 31 needs to have satisfactory conductivity to electrically connect the spacers 1020 to the metal back 1019 of the face plate 1017. For example, a conductive adhesive or conductive frit glass containing metal particles or conductive filler (ceramic particles having conductive surfaces by metal plating) is suitably used.

Outer terminals Dx1 to DxM, Dy1 to DyN, and Hv of the display panel are electric connection terminals for an airtight structure provided to electrically connect the display panel to an electric circuit (not shown). The terminal Dx1 to DxM are electrically connected to the row-direction wirings 1013 of the multi electron source; the terminals Dy1 to DyN, to the column-direction wirings 1014; and the terminal Hv, to the metal back 1019 of the face plate.

To evacuate the airtight container, after forming the airtight container, an exhaust pipe and a vacuum pump (neither is shown) are connected, and the airtight container is evacuated to a vacuum of about $10^{-7}$ Torr. Thereafter, the exhaust pipe is sealed. To maintain the vacuum in the airtight container, a getter film (not shown) is formed at a predetermined position in the airtight container immediately before/after the sealing. The getter film is a film formed by heating and evaporating a getter material mainly consisting of, e.g., Ba, by heating or RF heating. The suction effect of the getter film maintains a vacuum of $1\times10^{-5}$ or $1\times10^{-7}$ Torr in the container.

In the image display apparatus using the above display panel, when voltages are applied to the cold cathode devices 1012 through the outer terminals Dx1 to DXM and Dy1 to DyN, electrons are emitted by the cold cathode devices 1012. At the same time, a high voltage of several hundred V to several kV is applied to the metal back 1019 through the outer terminal Hv to accelerate the emitted electrons to cause them to collide with the inner surface of the face plate 1017. With this operation, the respective color fluorescent substances constituting the fluorescent film 1018 are excited to emit light to display an image.

The voltage to be applied to each surface-conduction emission type emitting device 1012 as a cold cathode device in this embodiment of the present invention is normally set to about 12 to 16 V; a distance d between the metal back 1019 and the cold cathode device 1012, about 0.1 mm to 8 mm; and the voltage to be applied between the metal back 1019 and the cold cathode device 1012, about 0.1 kV to 10 kV.

The basic arrangement of the display panel, the method of manufacturing the same, and the image display apparatus according to the embodiment of the present invention have been briefly described above.

Method of Manufacturing Multi Electron Source

A method of manufacturing the multi electron source used in the display panel of this embodiment will be described below. In manufacturing the multi electron source used in the image display apparatus of this embodiment, any material, shape, and manufacturing method for each surface-conduction emission type emitting device may be employed as long as an electron source can be obtained by arranging cold cathode devices in a simple matrix. Therefore, cold cathode devices such as surface-conduction emission type emitting devices, FE type devices, or MIM type devices can be used.

Under circumstances where inexpensive display apparatuses having large display areas are required, a surface-conduction emission type emitting device, of these cold cathode devices, is especially preferable. More specifically, the electron-emitting characteristic of an FE type device is greatly influenced by the relative positions and shapes of the emitter cone and the gate electrode, and hence a high-precision manufacturing technique is required to manufacture this device. This poses a disadvantageous factor in attaining a large display area and a low manufacturing cost. According to an MIM type device, the thicknesses of the insulating layer and the upper electrode must be decreased and made uniform. This also poses a disadvantageous factor in attaining a large display area and a low manufacturing cost. In contrast to this, a surface-conduction emission type emitting device can be manufactured by a relatively simple manufacturing method, and hence an increase in display area and a decrease in manufacturing cost can be attained. The present inventors have also found that among the surface-conduction emission type emitting devices, an electron emitting device having an electron-emitting portion or its peripheral portion consisting of a fine particle film is excellent in electron-emitting characteristic and can be easily manufactured. Such a device can therefore be most suitably used for the multi electron source of a high-brightness, large-screen image display apparatus. For this reason, in the display panel of this embodiment, surface-conduction emission type emitting devices each having an electron-emitting portion or its peripheral portion made of a fine particle film are used. The basic structure, manufacturing method, and characteristics of the preferred surface-conduction emission type emitting device will be described first. The structure of the multi electron source having many devices wired in a simple matrix will be described later.

Preferred Structure of Surface-Conduction Emission Type Emitting Device and Preferred Manufacturing Method Typical examples of surface-conduction emission type emitting devices each having an electron-emitting portion or its peripheral portion made of a fine particle film include two types of devices, namely flat and step type devices.

Flat Surface-Conduction Emission Type Emitting Device

First, the structure and manufacturing method of a flat surface-conduction emission type emitting device will be described.

Figure 7A:
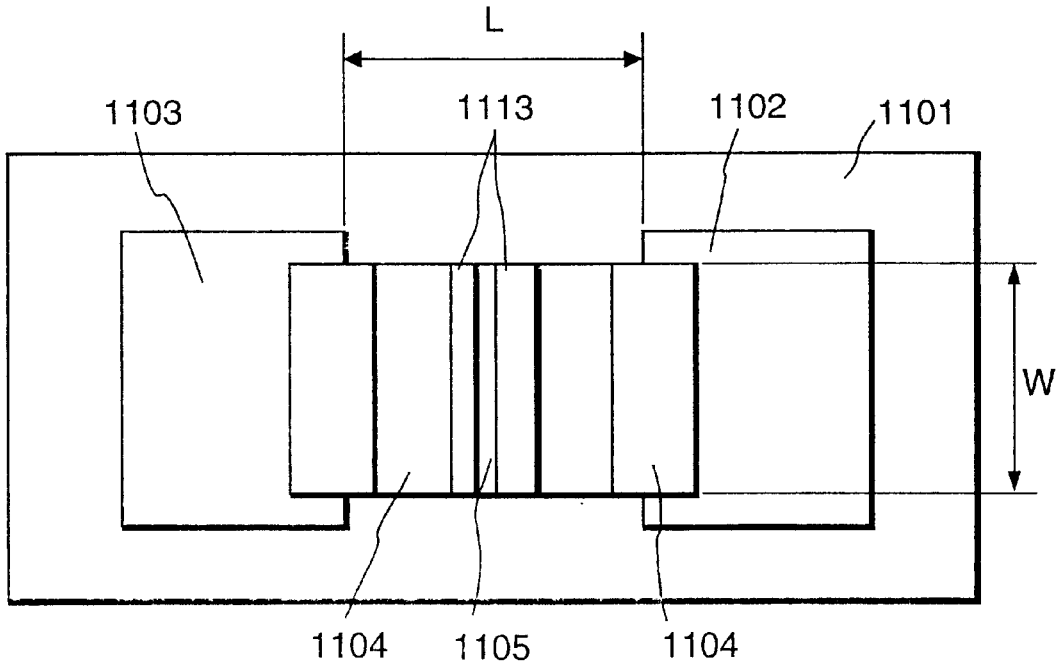
FIGS. 7A and 7B are a plan view and a sectional view, respectively, showing a flat surface-conduction emission type emitting device used in the embodiment.
Figure 7B:
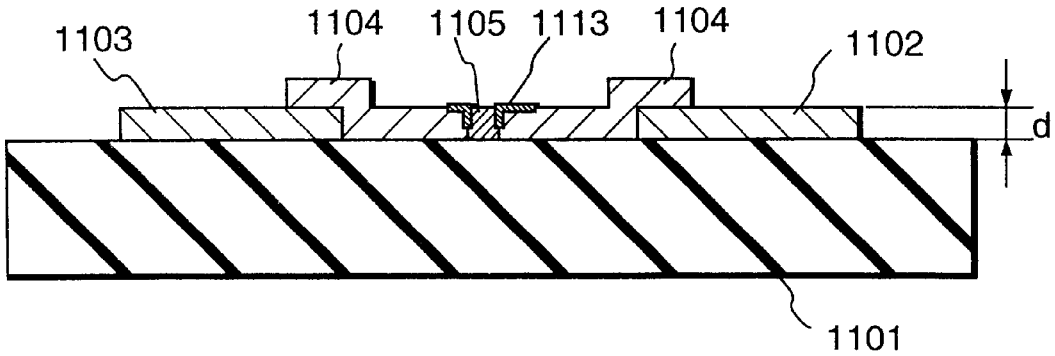

FIGS. 7A and 7B are a plan view and a sectional view, respectively, for explaining the structure of the flat surface-conduction emission type emitting device.

Referring to FIGS. 7A and 7B, reference numeral 1101 denotes a substrate; numerals 1102 and 1103 denote device electrodes; numeral 1104 denotes a conductive thin film; numeral 1105 denotes an electron-emitting portion formed by the forming processing; and numeral 1113 denotes a thin film formed by the activation processing.

As the substrate 1101, various glass substrates of, e.g., quartz glass and soda-lime glass, various ceramic substrates of, e.g., alumina, or any of those substrates with an insulating layer formed thereon can be employed. The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. These electrodes 1102 and 1103 can be easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundreds angstroms to hundreds micrometers. Most preferable range for a display apparatus is from several micrometers to tens micrometers. As for electrode thickness d, an appropriate value is selected in a range from hundreds angstroms to several micrometers.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other. One particle has a diameter within a range from several angstroms to thousands angstroms. Preferably, the diameter is within a range from 10 angstroms to 200 angstroms. The thickness of the film is appropriately set in consideration of conditions as follows. That is, condition necessary for electrical connection to the device electrode 1102 or 1103, condition for the forming processing to be described later, condition for setting electric resistance of the fine particle film itself to an appropriate value to be described later etc. Specifically, the thickness of the film is set in a range from several angstroms to thousands angstroms, more preferably, 10 angstroms to 500 angstroms.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$, carbides such as TiC, ZrC, HfC, TaC, SiC and WC and $GdB_4$, nitrides such as TiN, ZrN and HfN, semiconductors such as Si and Ge, and carbons. Any of appropriate material (s) is appropriately selected.

As described above, the conductive thin film 1104 is formed with a fine particle film, and sheet resistance of the film is set to reside within a range from $10^3$ to $10^7$ (Ω/sq).

As it is preferable that the conductive thin film 1104 is electrically connected to the device electrodes 1102 and 1103, they are arranged so as to overlap with each other at one portion. In FIG. 7B, the respective parts are overlapped in order of, the substrate 1101, the device electrodes 1102 and 1103, and the conductive thin film 1104, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than peripheral conductive thin film. The fissure is formed by the forming processing to be described later on the conductive thin film 1104. In some cases, particles, having a diameter of several angstroms to hundreds angstroms, are arranged within the fissured portion. As it is difficult to exactly illustrate actual position and shape of the electron-emitting portion, therefore, FIGS. 7A and 7B show the fissured portion schematically.

The thin film 1113, which comprises carbon or carbon compound material, covers the electron-emitting portion 1115 and its peripheral portion. The thin film 1113 is formed by the activation processing to be described later after the forming processing.

The thin film 1113 is preferably graphite monocrystalline, graphite polycrystalline, amorphous carbon, or mixture thereof, and its thickness is 500 angstroms or less, more preferably, 300 angstroms or less.

As it is difficult to exactly illustrate actual position or shape of the thin film 1113, FIGS. 7A and 7B show the film schematically. FIG. 7A shows the device where a part of the thin film 1113 is removed.

The preferred basic structure of the surface-conduction emission type emitting device is as described above. In the embodiment, the device has the following constituents.

That is, the substrate 1101 comprises a soda-lime glass, and the device electrodes 1102 and 1103, an Ni thin film. The electrode thickness d is 1000 angstroms and the electrode interval L is 2 μm.

The main material of the fine particle film is Pd or PdO. The thickness of the fine particle film is about 100 angstroms, and its width W is 100 μm.

Next, a method of manufacturing a preferred flat surface-conduction emission type emitting device will be described with reference to FIGS. 8A to 8D which are sectional views showing the manufacturing processes of the surface-conduction emission type emitting device. Note that reference numerals are the same as those in FIGS. 7A and 7B.

Figure 8A:
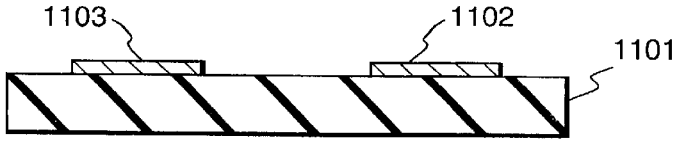
FIGS. 8A to 8E are sectional views showing the steps in manufacturing the flat surface-conduction emission type emitting device according to the embodiment.

(1) First, as shown in FIG. 8A, the device electrodes 1102 and 1103 are formed on the substrate 1101. In forming the electrodes 1102 and 1103, first, the substrate 1101 is fully washed with a detergent, pure water and an organic solvent, then, material of the device electrodes is deposited there. As a depositing method, a vacuum film-forming technique such as evaporation and sputtering may be used. Thereafter, patterning using a photolithography etching technique is performed on the deposited electrode material. Thus, the pair of device electrodes 1102 and 1103 shown in FIG. 8A are formed.

Figure 8B:
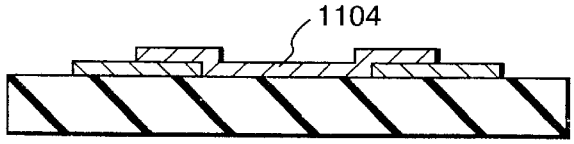

(2) Next, as shown in FIG. 8B, the conductive thin film 1104 is formed.

In forming the conductive thin film 1104, first, an organic metal solvent is applied to the substrate in FIG. 8A, then the applied solvent is dried and sintered, thus forming a fine particle film. Thereafter, the fine particle film is patterned into a predetermined shape by the photolithography etching method. The organic metal solvent means a solvent of organic metal compound containing material of minute particles, used for forming the conductive thin film, as main component, i.e., Pd in this embodiment. In the embodiment, application of organic metal solvent is made by dipping, however, any other method such as a spinner method and spraying method may be employed.

As a film-forming method of the conductive thin film 1104 made with the minute particles, the application of organic metal solvent used in the embodiment can be replaced with any other method such as a vacuum evaporation method, a sputtering method or a chemical vapor-phase accumulation method.

Figure 8C:
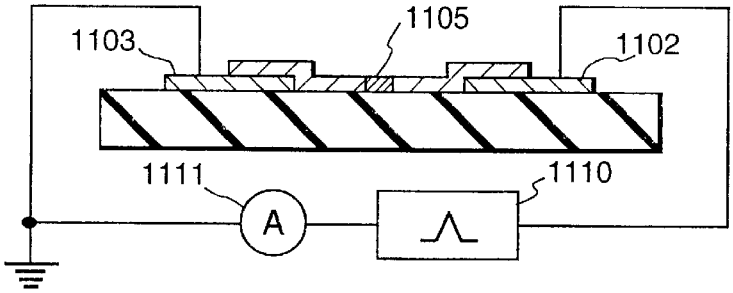

(3) Then, as shown in FIG. 8C, appropriate voltage is applied between the device electrodes 1102 and 1103, from a power source 1110 for the forming processing, then the forming processing is performed, thus forming the electron-emitting portion 1105. The forming processing here is electric energization of a conductive thin film 1104 formed of a fine particle film as shown in FIG. 8B, to appropriately destroy, deform, or deteriorate a part of the conductive thin film 1104, thus changing the film to have a structure suitable for electron emission. In the conductive thin film 1104, the portion changed for electron emission (i.e., electron-emitting portion 1105) has an appropriate fissure in the thin film. Comparing the thin film 1104 having the electron-emitting portion 1105 with the thin film before the forming processing, the electric resistance measured between the device electrodes 1102 and 1103 has greatly increased.

Figure 9:
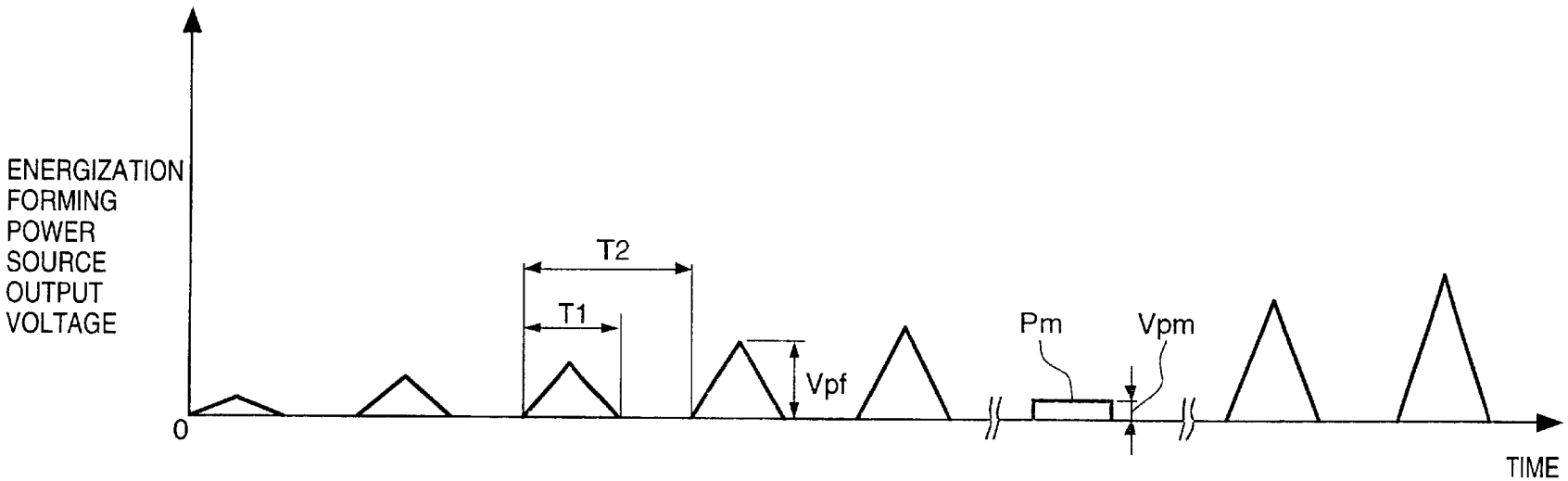
FIG. 9 is a graph showing the waveform of an application voltage in forming processing.

The electrification method in the forming processing will be explained in more detail with reference to FIG. 9 showing an example of waveform of appropriate voltage applied from the forming power source 1110.

Preferably, in case of forming a conductive thin film of a fine particle film, a pulse-form voltage is employed. In this embodiment, as shown in FIG. 9, a triangular-wave pulse having a pulse width T1 is continuously applied at pulse interval of T2. Upon application, a wave peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this embodiment, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electric resistance between the device electrodes 1102 and 1103 becomes $1\times10^{-6}$ Ω, i.e., the current measured by the galvanometer 1111 upon application of monitor pulse becomes $1\times10^{-7}$ A or less, the electrification of the forming processing is terminated.

Note that the above processing method is preferable to the surface-conduction emission type emitting device of this embodiment. In case of changing the design of the surface-conduction emission type emitting device concerning, e.g., the material or thickness of the fine particle film, or the device electrode interval L, the conditions for electrification are preferably changed in accordance with the change of device design.

Figure 8D:
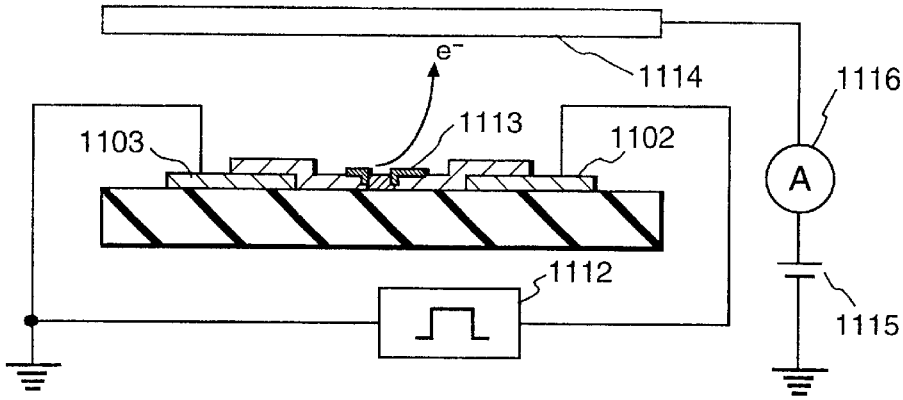

(4) Next, as shown in FIG. 8D, appropriate voltage is applied, from an activation power source 1112, between the device electrodes 1102 and 1103, and the activation processing is performed to improve electron-emitting characteristic. The activation processing here is electrification of the electron-emitting portion 1105 shown in FIG. 8C, formed by the forming processing, on appropriate condition (s), for depositing carbon or carbon compound around the electron-emitting portion 1105 (In FIG. 8D, the deposited material of carbon or carbon compound is shown as material 1113). Comparing the electron-emitting portion 1105 with that before the activation processing, the emission current at the same applied voltage has become, typically 100 times or greater.

The activation is made by periodically applying a voltage pulse in $10^{-2}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 10A:
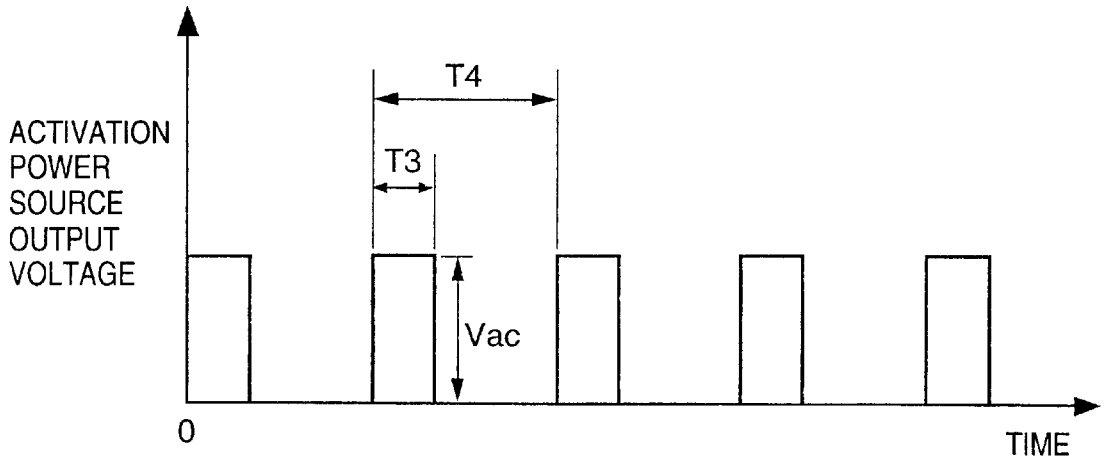
FIGS. 10A and 10B are graphs respectively showing the waveform of an application voltage in activation processing, and a change in emission current Ie in the activation processing.

The electrification method in this activation processing will be described in more detail with reference to FIG. 10A showing an example of waveform of appropriate voltage applied from the activation power source 1112. In this example, a rectangular-wave voltage Vac is set to 14 V; a pulse width T3, to 1 msec; and a pulse interval T4, to 10 msec. Note that the above electrification conditions are preferable for the surface-conduction emission type emitting device of the embodiment. In a case where the design of the surface-conduction emission type emitting device is changed, the electrification conditions are preferably changed in accordance with the change of device design.

Figure 10B:
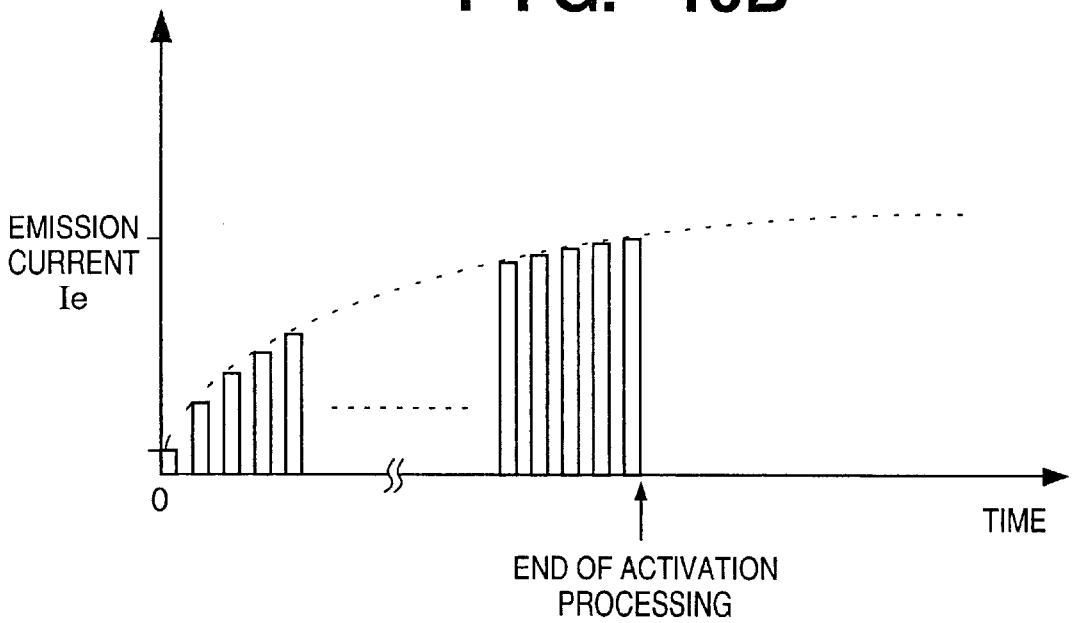

In FIG. 8D, reference numeral 1114 denotes an anode electrode, connected to a direct-current (DC) high-voltage power source 1115 and a galvanometer 1116, for capturing emission current Ie emitted from the surface-conduction emission type emitting device. In a case where the substrate 1101 is incorporated into the display panel before the activation processing, the Al layer on the fluorescent surface of the display panel is used as the anode electrode 1114. While applying voltage from the activation power source 1112, the galvanometer 1116 measures the emission current Ie, thus monitors the progress of activation processing, to control the operation of the activation power source 1112. FIG. 10B shows an example of the emission current Ie measured by the galvanometer 1116.

As application of pulse voltage from the activation power source 1112 is started in this manner, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the surface-conduction emission type emitting device of the embodiment. In case of changing the design of the surface-conduction emission type emitting device, the conditions are preferably changed in accordance with the change of device design.

Figure 8E:
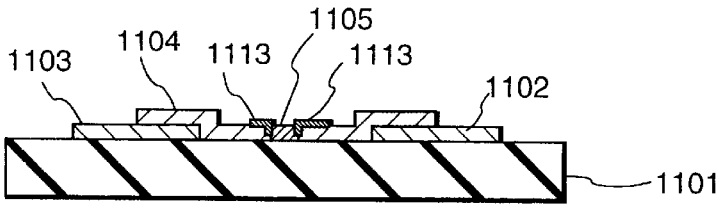

As described above, the surface-conduction emission type emitting device as shown in FIG. 8E is manufactured.

Step Surface-Conduction Emission Type Emitting Device

Next, another typical structure of the surface-conduction emission type emitting device where an electron-emitting portion or its peripheral portion is formed of a fine particle film, i.e., a stepped surface-conduction emission type emitting device will be described.

Figure 11:
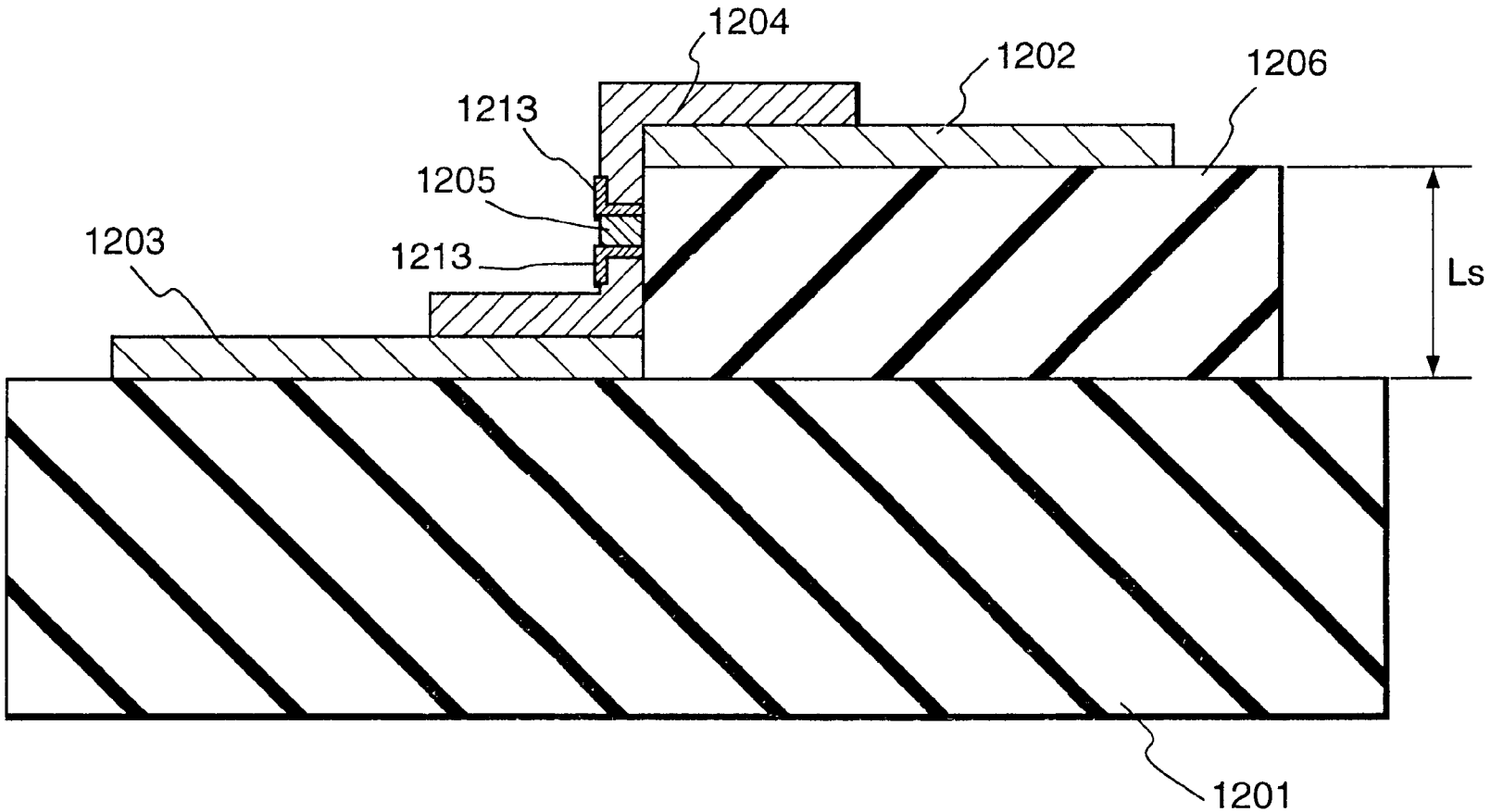
FIG. 11 is a sectional view showing a step surface-conduction emission type emitting device used in the embodiment.

FIG. 11 is a sectional view schematically showing the basic construction of the step surface-conduction emission type emitting device.

Referring to FIG. 11, reference numeral 1201 denotes a substrate; numerals 1202 and 1203 denote device electrodes; numeral 1206 denotes a step-forming member for making height difference between the electrodes 1202 and 1203; numeral 1204 denotes a conductive thin film using a fine particle film; numeral 1205 denotes an electron-emitting portion formed by the forming processing; and numeral 1213 denotes a thin film formed by the activation processing.

Difference between the step surface-conduction emission type emitting device from the above-described flat electron-emitting device structure is that one of the device electrodes (1202 in this example) is provided on the step-forming member 1206 and the conductive thin film 1204 covers the side surface of the step-forming member 1206. The device interval L in FIGS. 7A and 7B is set in this structure as a height difference Lst corresponding to the height of the step-forming member 1206. Note that the substrate 1201, the device electrodes 1202 and 1203, the conductive thin film using the fine particle film can comprise the materials given in the explanation of the flat surface-conduction emission type emitting device. Further, the step-forming member 1206 comprises electrically insulating material such as $SiO_2$.

Next, a method of manufacturing the stepped surface-conduction emission type emitting device will be described with reference FIGS. 12A to 12F which are sectional views showing the manufacturing processes. In these figures, reference numerals of the respective parts are the same as those in FIG. 10.

Figure 12A:
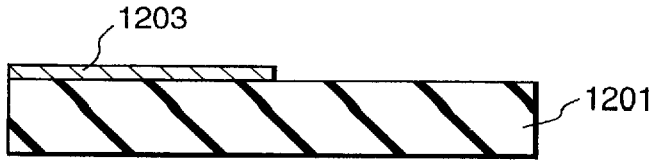
FIGS. 12A to 12F are sectional views showing the steps in manufacturing the step surface-conduction emission type emitting device.

(1) First, as shown in FIG. 12A, the device electrode 1203 is formed on the substrate 1201.

Figure 12B:
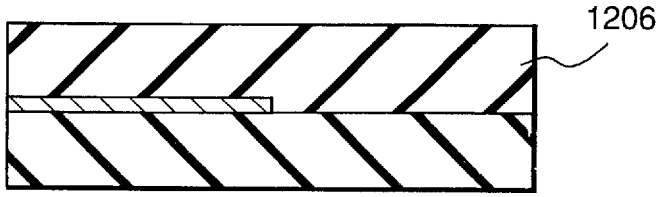

(2) Next, as shown in FIG. 12B, the insulating layer 1206 for forming the step-forming member is deposited. The insulating layer 1206 may be formed by accumulating, e.g., $SiO_2$ by a sputtering method, however, the insulating layer may be formed by a film-forming method such as a vacuum evaporation method or a printing method.

Figure 12C:
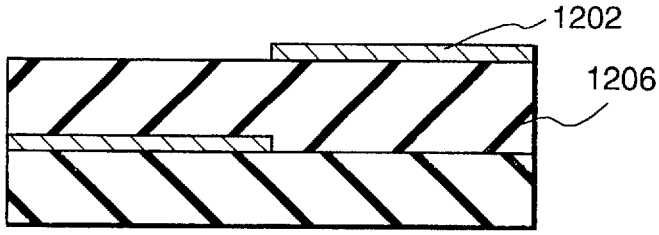

(3) Next, as shown in FIG. 12C, the device electrode 1202 is formed on the insulating layer 1206.

Figure 12D:
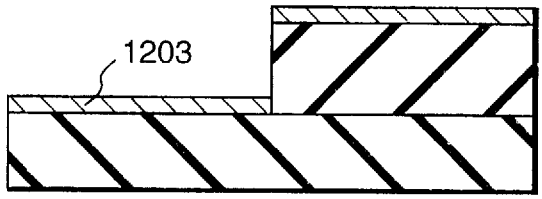

(4) Next, as shown in FIG. 12D, a part of the insulating layer 1206 in FIG. 12C is removed by using, e.g., an etching method, to expose the device electrode 1203.

Figure 12E:
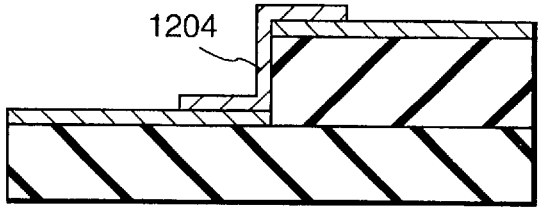

(5) Next, as shown in FIG. 12E, the conductive thin film 1204 using the fine particle film is formed. Upon formation, similar to the above-described flat device structure, a film-forming technique such as an applying method is used.

(6) Next, similar to the flat device structure, the forming processing is performed to form the electron-emitting portion 1205. (The forming processing similar to that explained using FIG. 8C may be performed).

(7) Next, similar to the flat device structure, the activation processing is performed to deposit carbon or carbon compound around the electron-emitting portion. (Activation processing similar to that explained using FIG. 8D may be performed).

Figure 12F:
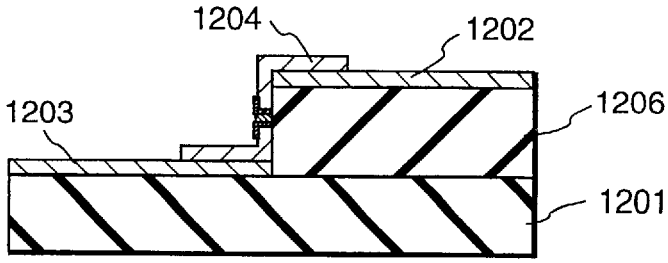

As described above, the stepped surface-conduction emission type emitting device shown in FIG. 12F is manufactured.

Characteristic of Surface-Conduction Emission Type Emitting Device Used in Display Apparatus The structure and manufacturing method of the flat surface-conduction emission type emitting device and those of the stepped surface-conduction emission type emitting device are as described above. Next, the characteristic of the electron-emitting device used in the display apparatus will be described below.

Figure 13:
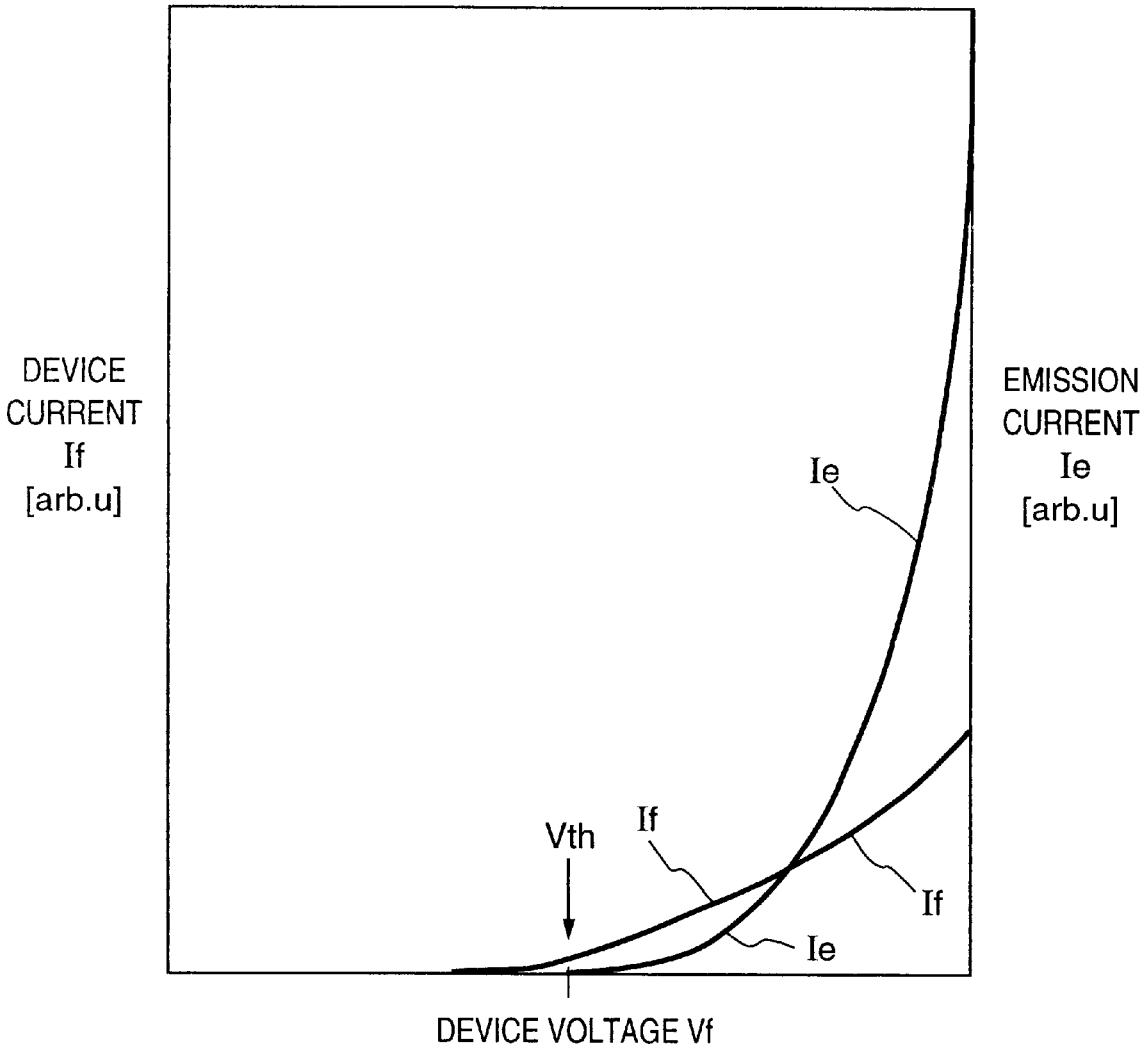
FIG. 13 is a graph showing the typical characteristics of the surface-conduction emission type emitting device used in the embodiment.

FIG. 13 shows a typical example of (emission current Ie) to (device voltage (i.e., voltage to be applied to the device) Vf) characteristic and (device current If) to (device application voltage Vf) characteristic of the device used in the display apparatus of this embodiment. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 13 are respectively given in arbitrary units.

Regarding the emission current Ie, the device used in the display apparatus has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected. That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the device voltage Vf.

Third, the emission current Ie is output quickly in response to application of the device voltage Vf to the surface-conduction emission type emitting device. Accordingly, an electrical charge amount of electrons to be emitted from the device can be controlled by changing period of application of the device voltage Vf.

The surface-conduction emission type emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-gradation display.

Structure of Multi Electron Source with Many Devices Wired in Simple Matrix

Next, the structure of the multi electron source having the above-described surface-conduction emission type emitting devices arranged on the substrate with the simple-matrix wiring will be described below.

FIG. 3 is a plan view of the multi electron source used in the display panel in FIG. 2. There are surface-conduction emission type emitting devices like the one shown in FIGS. 7A and 7B on the substrate 1011. These devices are arranged in a simple matrix with the row-direction wiring 1013 and the column-direction wiring 1014. At an intersection of the wirings 1013 and 1014, an insulating layer (not shown) is formed between the wires, to maintain electrical insulation.

FIG. 4 shows a cross-section cut out along the line B-B' in FIG. 3.

Note that a multi electron source having such a structure is manufactured by forming the row- and column-direction wirings 1013 and 1014, the inter-electrode insulating layers (not shown), and the device electrodes and conductive thin films of the surface-conduction emission type emitting devices on the substrate, then supplying electricity to the respective devices via the row- and column-direction wirings 1013 and 1014, thus performing the forming processing (to be described later) and the activation processing (to be described later).

Figure 14:
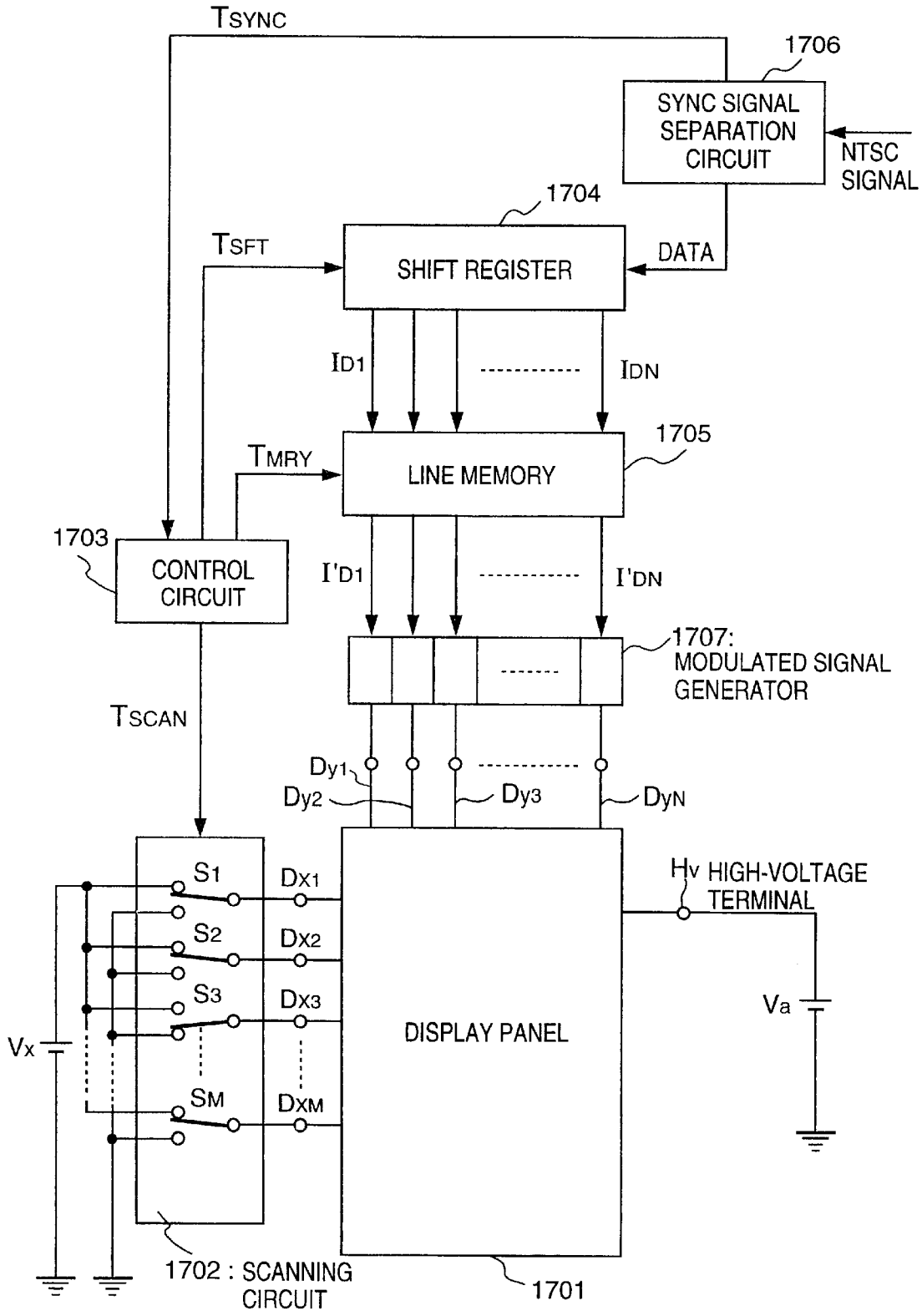
FIG. 14 is a block diagram showing the schematic arrangement of a driving circuit for the image display apparatus according to the embodiment of the present invention.
Figure 15:
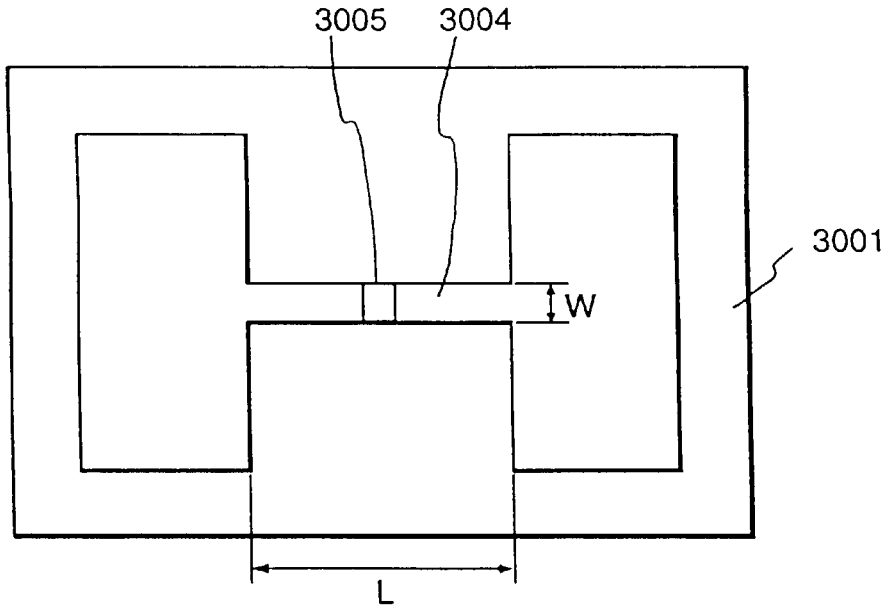
FIG. 15 (PRIOR ART)
FIG. 15 is a plan view showing an example of a conventionally known surface-conduction emission type emitting device.
Figure 16:
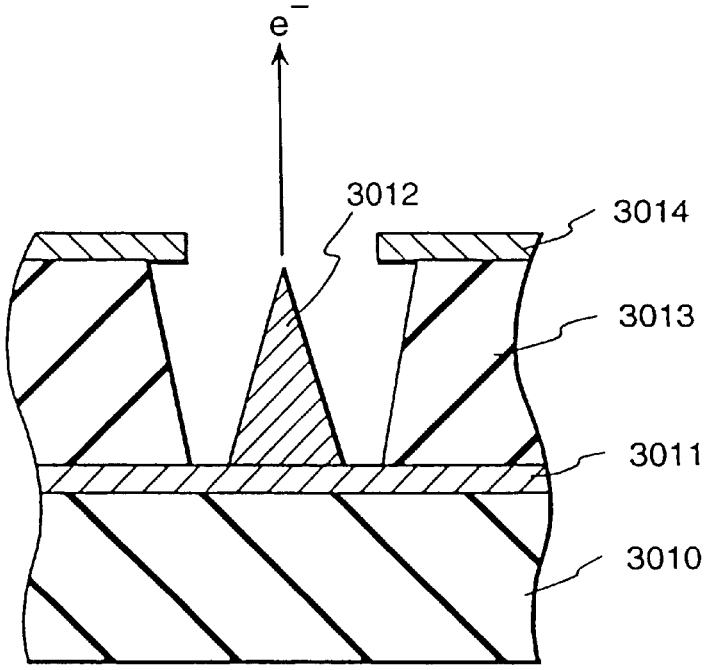
FIG. 16 (PRIOR ART)
FIG. 16 is a sectional view showing an example of a conventionally known FE type device.
Figure 17:
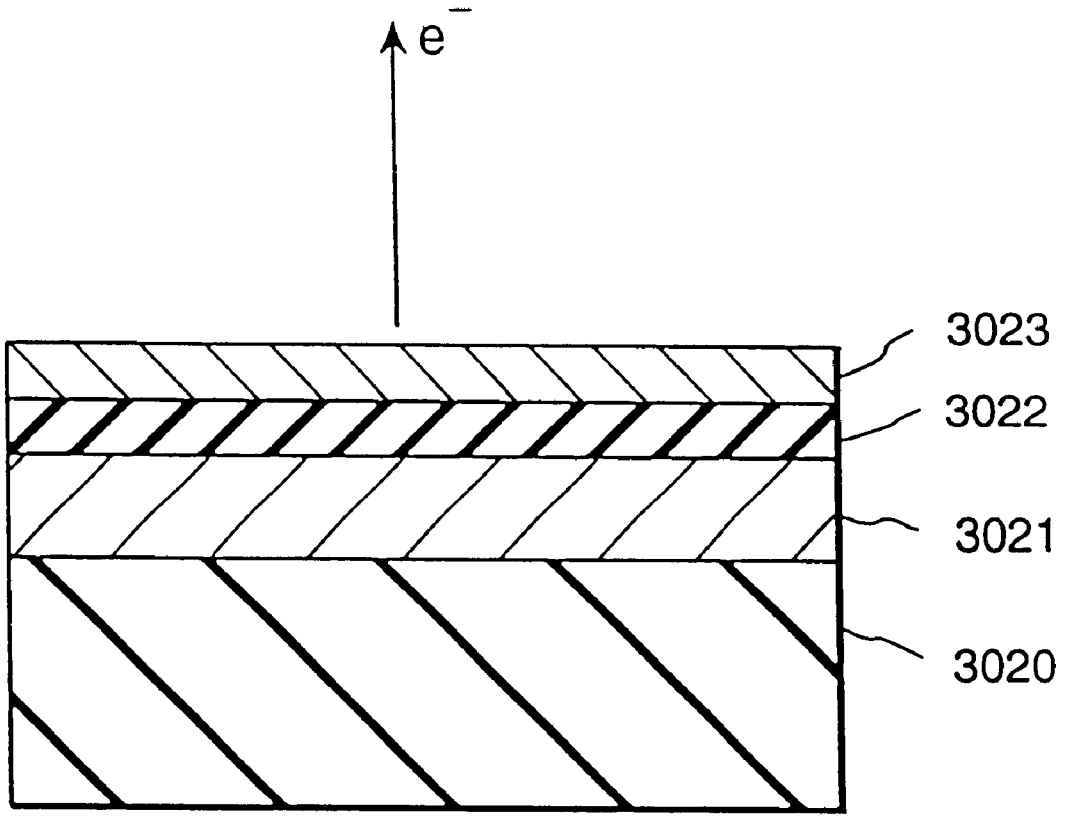
FIG. 17 (PRIOR ART)
FIG. 17 is a sectional view showing an example of a conventionally known MIM type device.

FIG. 14 is a block diagram showing the schematic arrangement of a driving circuit for performing television display on the basis of a television signal of the NTSC scheme. Referring to FIG. 14, a display panel 1701 corresponds to the display panel described above. This panel is manufactured and operates in the same manner described above. A scanning circuit 1702 scans display lines. A control circuit 1703 generates signals and the like to be input to the scanning circuit. A shift register 1704 shifts data in units of lines. A line memory 1705 inputs 1-line data from the shift register 1704 to a modulated signal generator 1707. A sync signal separation circuit 1706 separates a sync signal from an NTSC signal.

The function of each component in FIG. 14 will be described in detail below.

The display panel 1701 is connected to an external electric circuit through terminals Dx1 to DxM and Dy1 to DyN and a high-voltage terminal Hv. Scanning signals for sequentially driving the multi electron source in the display panel 1701, i.e., the cold cathode devices wired in a M×N matrix in units of lines (in units of n devices) are applied to the terminals Dx1 to DxM. Modulated signals for controlling the electron beams output from n devices corresponding to one line, which are selected by the above scanning signals, are applied to the terminals Dy1 to DyN. For example, a DC voltage of 5 kV is applied from a DC voltage source Va to the high-voltage terminal Hv. This voltage is an accelerating voltage for giving energy enough to excite the fluorescent substances to the electron beams output from the multi electron source.

The scanning circuit 1702 will be described next. This circuit incorporates M switching elements (denoted by reference symbols S1 to SM in FIG. 14). Each switching element serves to select either an output voltage from a DC voltage source Vx or 0 V (ground level) and is electrically connected to a corresponding one of the terminals Dx1 to DxM of the display panel 1701. The switching elements S1 to SM operate on the basis of a control signal TSCAN output from the control circuit 1703. In practice, this circuit can be easily formed in combination with switching elements such as FETs. The DC voltage source Vx is set on the basis of the characteristics of the electron-emitting device in FIG. 13 to output a constant voltage such that the driving voltage to be applied to a device which is not scanned is set to an electron emission threshold voltage Vth or lower.

The control circuit 1703 serves to match the operations of the respective components with each other to perform proper display on the basis of an externally input image signal. The control circuit 1703 generates control signals TSCAN, TSFT, and TMRY for the respective components on the basis of a sync signal TSYNC sent from the sync signal separation circuit 1706 to be described next. The sync signal separation circuit 1706 is a circuit for separating a sync signal component and a luminance signal component from an externally input NTSC television signal. As is known well, this circuit can be easily formed by using a frequency separation (filter) circuit. The sync signal separated by the sync signal separation circuit 1706 is constituted by vertical and horizontal sync signals, as is known well. In this case, for the sake of descriptive convenience, the sync signal is shown in FIG. 14 as the signal TSYNC. The luminance signal component of an image, which is separated from the television signal, is expressed as a signal DATA for the sake of descriptive convenience. This signal is input to the shift register 1704.

The shift register 1704 performs serial/parallel conversion of the signal DATA, which is serially input in a time-series manner, in units of lines of an image. The shift register 1704 operates on the basis of the control signal TSFT sent from the control circuit 1703. In other words, the control signal TSFT is a shift clock for the shift register 1704. One-line data (corresponding to driving data for n electron-emitting devices) obtained by serial/parallel conversion is output as N signals ID1 to IDN from the shift register 1704.

The line memory 1705 is a memory for storing 1-line data for a required period of time. The line memory 1705 properly stores the contents of the signals ID1 to IDN in accordance with the control signal TMRY sent from the control circuit 1703. The stored contents are output as data I'D1 to I'DN to be input to the modulated signal generator 1707.

The modulated signal generator 1707 is a signal source for performing proper driving/modulation with respect to each electron-emitting device 1015 in accordance with each of the image data I'D1 to I'DN. Output signals from the modulated signal generator 1707 are applied to the electron-emitting devices 1015 in the display panel 1701 through the terminals Dy1 to DyN.

The surface-conduction emission type emitting device according to this embodiment has the following basic characteristics with respect to an emission current Ie, as described above with reference to FIG. 13. A clear threshold voltage Vth (8 V in the surface-conduction emission type emitting device of the embodiment described later) is set for electron emission. Each device emits electrons only when a voltage equal to or higher than the threshold voltage Vth is applied. In addition, the emission current Ie changes with a change in voltage equal to or higher than the electron emission threshold voltage Vth, as indicated by the graph of FIG. 13. Obviously, when a pulse-like voltage is to be applied to this device, no electrons are emitted if the voltage is lower than the electron emission threshold voltage Vth. If, however, the voltage is equal to or higher than the electron emission threshold voltage Vth, the surface-conduction emission type emitting device emits an electron beam. In this case, the intensity of the output electron beam can be controlled by changing a peak value Vm of the pulse. In addition, the total amount of electron beam charges output from the device can be controlled by changing a width Pw of the pulse.

As a scheme of modulating an output from each electron-emitting device in accordance with an input signal, therefore, a voltage modulation scheme, a pulse width modulation scheme, or the like can be used. In executing the voltage modulation scheme, a voltage modulation circuit for generating a voltage pulse with a constant length and modulating the peak value of the pulse in accordance with input data can be used as the modulated signal generator 1707. In executing the pulse width modulation scheme, a pulse width modulation circuit for generating a voltage pulse with a constant peak value and modulating the width of the voltage pulse in accordance with input data can be used as the modulated signal generator 1707.

As the shift register 1704 and the line memory 1705 may be of the digital signal type or the analog signal type. That is, it suffices if an image signal is serial/parallel-converted and stored at predetermined speeds.

When the above components are of the digital signal type, the output signal DATA from the sync digital signal separation circuit 1706 must be converted into a digital signal. For this purpose, an A/D converter may be connected to the output terminal of the sync signal separation circuit 1706. Slightly different circuits a reused for the modulated signal generator depending on whether the line memory 1705 outputs a digital or analog signal. More specifically, in the case of the voltage modulation scheme using a digital signal, for example, a D/A conversion circuit is used as the modulated signal generator 1707, and an amplification circuit and the like are added thereto, as needed. In the case of the pulse width modulation scheme, for example, a circuit constituted by a combination of a high-speed oscillator, a counter for counting the wave number of the signal output from the oscillator, and a comparator for comparing the output value from the counter with the output value from the memory is used as the modulated signal generator 1707. This circuit may include, as needed, an amplifier for amplifying the voltage of the pulse width modulated signal output from the comparator to the driving voltage for the electron-emitting device.

In the case of the voltage modulation scheme using an analog signal, for example, an amplification circuit using an operational amplifier and the like may be used as the modulated signal generator 1707, and a shift level circuit and the like may be added thereto, as needed. In the case of the pulse width modulation scheme, for example, a voltage-controlled oscillator (VCO) can be used, and an amplifier for amplifying an output from the oscillator to the driving voltage for the electron-emitting device can be added thereto, as needed.

In the image display apparatus of this embodiment which can have one of the above arrangements, when voltages are applied to the respective electron-emitting devices through the outer terminals Dx1 to DxM and Dy1 to DyN, electrons are emitted. A high voltage is applied to the metal back 1019 or the transparent electrode (not shown) through the high-voltage terminal Hv to accelerate the electron beams. The accelerated electrons collide with the fluorescent film 1018 to cause it to emit light, thereby forming an image.

The above arrangement of the image display apparatus is an example of an image forming apparatus to which the present invention can be applied. Various changes and modifications of this arrangement can be made within the spirit and scope of the present invention. Although a signal based on the NTSC scheme is used as an input signal, the input signal is not limited to this. For example, the PAL scheme and the SECAM scheme can be used. In addition, a TV signal (high-definition TV such as MUSE) scheme using a larger number of scanning lines than these schemes can be used.

Embodiment

The present invention will be further described below by referring to embodiments.

In the respective embodiments described below, a multi electron source is formed by wiring N×M (N=3,072, M=1,024) surface-conduction emission type emitting devices, each having an electron-emitting portion at a conductive fine particle film between electrodes as described above, in a matrix using M row-direction wirings and N column-direction wirings (see FIGS. 2 and 3).

In the respective embodiments described below, as shown in FIG. 6, the face plate 1017 has the fluorescent film 1018 in which fluorescent substances in respective colors have striped shapes extending in the column direction (Y direction), and the black conductive members 1010 are arranged not only between the stripes of the fluorescent substances in the respective colors but also in the direction (X direction) perpendicular to the stripes so as to separate the pixels in the row and column directions.

First Embodiment

In the first embodiment, an image display apparatus with a display panel using the spacers 1020 described with reference to FIGS. 1 and 2 was manufactured. The first embodiment will be described in detail below with reference to FIGS. 1 and 2.

A spacer 1020 used in the first embodiment was manufactured in the following manner.

(1) Glass of the same kind as glass for a face plate 1017 and a substrate 1011 was used, and cut and polished into a length of 20 mm, a height of 5 mm, and a thickness of 0.2 mm. The resultant glass was used as an insulating member 1.

(2) As a high-resistance film 11, a Cr—Al alloy nitride film was formed on the surface of the insulating member 1. The high-resistance film 11 was formed to have a thickness of 200 nm by reactive sputtering simultaneously using Cr and Al targets in the nitride gas atmosphere. The sheet resistance of the high-resistance film 11 was about $10^9$ Ω/sq.

(3) On the insulating member 1 having the surface covered with the high-resistance film 11, low-resistance films 21*a* and 21*b* and a protective film 23 were sequentially formed on abutment surfaces 3*a* and 3*b* on the face plate 1017 side and the substrate 1011 side, and the side surface on the face plate side by RF-sputtering Ti and Pt targets to thicknesses of 50 angstrom and 2,000 angstrom. The remaining portion except for the film-forming portions was covered with a metal mask. As a layer below the Pt layer, a 50 angstrom thick Cr layer or 50 angstrom thick Ta layer was formed in stead of the Ti layer.

A display panel was assembled by the following process using the spacers 1020 manufactured in the above manner.

(1) A joining material 31 (line width: 250 μm, height: 200 μm) made of conductive frit glass, which contained a conductive filler with a surface coated by gold, was applied through a metal back 1019 onto a portion to abut against each spacer 1020 in a region (line with: 300 μm) extending in the row direction (X direction) of a black conductive member 1010 of a fluorescent film 1018 on the face plate 1017 side.

(2) The spacer 1020 was arranged in the region of the face plate 1017 where the joining material 31 was applied, sintered in air at 400° C. to 500° C. for 10 min or more to adhere the spacer 1020 to the face plate 1017 side, and also electrically connected to the metal back 1019. In this case, the spacer 1020 was satisfactorily positioned with respect to the face plate 1017. Particularly, the inclination (upright angle) of the spacer 1020 with respect to the surface of the face plate 1017 was adjusted to fall within the range of 90°±5°.

(3) A substrate 1011 on which row- and column-direction wirings 1013 and 1014, inter-electrode insulating layers (not shown), and device electrodes and conductive thin films of surface-conduction emission type emitting devices were formed was satisfactorily positioned and fixed to a rear plate 1015.

The row- and column-direction wirings 1013 and 1014 were formed by that silver paste including Ag and glass components is printed and then burned.

As shown in FIG. 20, each row-direction wiring 1013 has a projecting shape at a portion where the column-direction wiring 1014 and an insulating layer 1099 exist.

(4) The face plate 1017 to which the spacers 1020 were adhered, and the rear plate 1015 to which the substrate 1011 was fixed were made to face each other through side walls 1016. In this case, the abutment end of each spacer 1020 on which the low-resistance film 21*b* was formed was arranged above the row-direction wirings 1013 on the rear plate 1015 side, and the rear plate 1015, the face plate 1017, and the side walls 1016 were fixed, as shown in FIGS. 1, 2, and 20. The joining portions between the substrate 1011 and the rear plate 1015, between the rear plate 1015 and the side walls 1016, and between the face plate 1017 and the side walls 1016 were coated with frit glass (not shown). The resultant structure was sintered at 400° C. to 500° C. in air for 10 min or more to seal the components. In this case, the rear plate 1015 and the face plate 1017 were satisfactorily positioned in order to make the fluorescent substances in respective colors on the face plate 1017 and cold cathode devices 1012 on the substrate 1011 correspond to each other.

The airtight container constituting the display panel was completed by the above process.

The airtight container completed in the above process was evacuated by a vacuum pump through an exhaust pipe (not shown) to attain a sufficient vacuum. Thereafter, power was supplied to the respective devices through the outer terminals Dx1 to DxM and Dy1 to DyN, the row-direction wirings 1013, and the column-direction wirings 1014 to perform the above forming processing and activation processing, thereby manufacturing a multi electron source.

The exhaust pipe (not shown) was heated and welded to seal the envelope (airtight container) in a vacuum of about $10^{-6}$ Torr using a gas burner.

Finally, gettering was performed to maintain the vacuum after sealing.

In the image display apparatus using the display panel completed in the above process and shown in FIGS. 1 and 2, scanning signals and modulated signals were applied from a signal generating means (not shown) to the respective cold cathode devices (surface-conduction emission type emitting devices) 1012 through the outer terminals Dx1 to DxM and Dy1 to DyN to cause the devices to emit electrons. A high voltage was applied to the metal back 1019 through the high-voltage terminal Hv to accelerate the emitted electron beams to cause the electrons to collide with the fluorescent film 1018. As a result, the fluorescent substances in the respective colors (R, G, and B in FIG. 6) were excited to emit light, thereby displaying an image. Note that a voltage Va to be applied to the high-voltage terminal Hv was set to 3 kV to 10 kV, and a voltage Vf to be applied between each row-direction wiring 1013 and each column-direction wiring 1014 was set to 14 V.

In this case, emission spot rows were formed two-dimensionally at equal intervals, including emission spots formed by the electrons emitted by the cold cathode devices 1012 near the spacers 1020. As a result, a clear color image with good color reproduction characteristics could be displayed. This indicates that the formation of the spacers 1020 did not produce any electric field disturbance that affected the orbits of electrons.

An embodiment using spacers 1020 with no protective layer 23 is also one of the embodiments of the present invention, and the same effects as those described above can also be obtained. However, the first embodiment in which the protective layer 23 is formed on the spacer 1020 is more preferable in terms of prevention of distortion of a display image near the spacer 1020.

An embodiment in which a low-resistance film 21*b* on a substrate 1011 side having cold cathode devices 1012 is formed to the side surface portion (height: 0.3 mm) of a spacer 1020 is also one of the embodiments of the present invention, and the same effects as those described above can be obtained. However, the first embodiment (FIGS. 1 and 19) is more preferable in order to prevent distortion of a display image near the spacer 1020 which is caused by the shift of the electron beam in the direction away from the spacer 1020.

In the first embodiment, the spacer 1020 is abutted against the substrate 1011 via a soft material at the atmospheric pressured applied upon evacuating the airtight container. Compared to the case wherein the display panel is assembled using the joining material 31 on both the face plate 1017 side and the substrate 1011 side, the spacer can be more reliably prevented from falling down and being damaged at the abutment portion. Further, the spacer is electrically connected on the substrate 1011 side more reliably. This leads to easy assembling of the airtight container and an increase in yield.

Second Embodiment

In the second embodiment, as a protective layer 23, a silicon nitride film (thickness: 500 nm, height: 0.3 mm) serving as an insulating film was used. As a result, an image could be displayed similarly to the first embodiment.

As has been described above, according to the present invention, an image forming apparatus having spacers excellent in fixing strength inside the apparatus can be provided.

Particularly, an image forming apparatus having spacers which are fixed on an image forming member but only abutted on a member opposing the image forming member, and are excellent in fixing strength inside the apparatus can be provided.

In addition, a method of manufacturing an image forming apparatus, which can facilitate arrangement of spacers in assembling the image forming apparatus because one end of each spacer is only abutted, can be provided.

According to the manufacturing method of the present invention, the spaces are disposed between the image forming member and the member opposing the image forming member, and are only fixed to the image forming member. This results in the merits as follows.

If the spacers are fixed to both the image forming member and the member opposing the image forming member, then the mechanical and electrical connections between the spacers and both the image forming member and the member opposing the image forming member, are simultaneously performed by pressing the spacers toward the member and the image forming member with a predetermined pressure. In order to press the spacers with the predetermined pressure, since the surfaces of the member and the image forming member must be in parallel and heights of the spacers must be even, the mechanical accuracy of the manufacturing apparatus is requested. Further, in order to simultaneously fasten the spacers to both the image forming member and the member opposing the image forming member, the higher pressure is needed and this causes cost-up of the manufacturing apparatus.

According to the present invention, the spacers are fixed to the image forming member so that mechanical and electrical connections between the spacers and image forming member are reliably attained and the pressure to the spacer can be reduced upon fastening the spacers. Since the spacers are not simultaneously fixed to the member opposing the image forming member, the unevenness of the pressure to the spacers is not caused because of the warp of the member. Further, even if the image forming member was warped, it would be easy that the mechanical portions for pressuring the spacers are divided into plural sections in respect with an area of the image forming member so that the uniformity of the pressure to the spacers can be accomplished.

Furthermore, according to the present invention, the spacers placed between the image forming member and the member opposing the image forming member are first fixed to the image forming member and brought into contact with the member opposing the image forming member. The inside of the image display panel has been made vacuous so that the electrical contact between the spacers and the member opposing the image forming member becomes more reliable. Therefore, the degree of the parallel on the surfaces of the member and the image forming member and the uniformity of heights of the spacers can be degraded.

As for a conductive spacer, the charge-up of the surface of the spacer, and errors of electrical connection at the connected portion of the spacer can be reduced.

The number of factors of shifting the electron orbit near the spacer can be decreased.

Since the orbit of the electron beam hardly shifts, an image forming apparatus capable of displaying a clear image with good color reproducibility free from brightness irregularity or color misregistration can be obtained.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

an electron source including a plurality of electron-emitting devices;

an image forming member for forming an image upon irradiation of electrons emitted by said electron source;

an opposing member disposed opposite to said image forming member and including a substrate on which said electron source is arranged; and a spacer arranged between said image forming member and said opposing member, said spacer having conductivity and being fixed to said image forming member with a joining material, wherein said spacer is electrically connected with wiring on said substrate via a soft conductive member, and said soft conductive member is a softer member than said spacer and the wiring.

2. The apparatus according to claim 1, wherein said plurality of electron-emitting devices are wired in a matrix through a plurality of row-direction wirings and a plurality of column-direction wirings, and said spacer is in contact with said row-direction wirings or said column-direction wirings.

3. The apparatus according to claim 2, wherein said spacer is a rectangular spacer, and abutment surfaces of said row-direction wirings or said column-direction wirings are corrugated.

4. The apparatus according to claim 1, wherein a welded jointing material fixes said spacer to said image forming member.

5. The apparatus according to claim 1, wherein said soft member is a member made including a noble metal or an alloy of the noble metal.

6. The apparatus according to claim 1, wherein said electron source includes a plurality of cold cathode devices.

7. The apparatus according to claim 6, wherein each of said cold cathode devices includes a conductive film having an electron-emitting portion between electrodes.

8. The apparatus according to claim 6, wherein each of said cold cathode devices includes a surface-conduction emission type emitting device.

9. The apparatus according to claim 6, wherein said plurality of electron-emitting devices are wired in a matrix through a plurality of row-direction wirings and a plurality of column-direction wirings, and said spacer is electrically connected to said row-direction wirings or said column-direction wirings via said soft conductive member.

10. The apparatus according to claim 9, wherein said soft conductive member is a member made of a material selected from the group consisting of a noble metal or an alloy of the noble metal.

11. The apparatus according to claim 10, further comprising an acceleration electrode arranged on said image forming member, for accelerating electrons emitted by said electron source, wherein said spacer is electrically connected to said acceleration electrode.

12. The apparats according to claim 11, wherein said spacer is fixed to said acceleration electrode through a noble metal film.

13. The apparatus according to claim 11, wherein a welded joining material fixes said spacer to said acceleration electrode.

14. The apparatus according to claim 9, wherein said spacer is a rectangular spacer, and an abutment surface of said row-direction wiring or said column-direction wiring has corrugation.

15. The apparatus according to claim 1, wherein said spacer has a sheet resistance falling within a range of $10^5$ Ω/sq to $10^{12}$ Ω/sq.

16. The apparatus according to claim 1, wherein said soft conductive member is a member including a noble metal or an alloy of the noble metal.

17. The apparatus according to claim 1, further comprising an acceleration electrode arranged on said image forming member to accelerate electrons emitted by said electron source, wherein said spacer is electrically connected to said acceleration electrode.

18. The apparatus according to claim 17, wherein said spacer is fixed to said acceleration electrode through a noble metal film.

19. The apparatus according to claim 17, wherein a welded jointing material fixes said spacer to said acceleration electrode.

20. The apparatus according to claim 1, wherein said electron source has a plurality of cold cathode devices.

21. The apparatus according to claim 20, wherein each of said cold cathode devices includes a conductive film having an electron-emitting portion between electrodes.

22. The apparatus according to claim 20, wherein each of said cold cathode devices is a surface-conduction emission type emitting device.

* * * * *

UNITED STATES PATENT AND TRADEMARK OFFICE

CERTIFICATE OF CORRECTION

PATENT NO. : 6,512,329 B1
DATED : January 28, 2003
INVENTOR(S) : Hideaki Mitsutake et al.

It is certified that error appears in the above-identified patent and that said Letters Patent is hereby corrected as shown below:

Title page,
Item [56], References Cited, U.S. PATENT DOCUMENT, "Misutake et al." should read -- Mitsutake et al. --.

Column 1,
Line 62, "go" should be deleted.

Column 2,
Line 26, "agate" should read -- a gate --.

Column 25,
Line 18, "a reused" should read -- are used --.

Column 30,
Line 29, "apparats" should read -- apparatus --.

Signed and Sealed this

Twenty-third Day of September, 2003

JAMES E. ROGAN
*Director of the United States Patent and Trademark Office*